US005616926A

United States Patent [19]

Shinada et al.

[11] Patent Number: 5,616,926

[45] Date of Patent: Apr. 1, 1997

[54] SCHOTTKY EMISSION CATHODE AND A METHOD OF STABILIZING THE SAME

[75] Inventors: Hiroyuki Shinada, Choufu; Shingo Kimura, Kudamatsu; Katsuhiro Kuroda, Hachiouji; Satoru Fukuhara, Hitachinaka; Takashi Ohshima, Akishima, all of Japan

[73] Assignee: Hitachi, Ltd., Tokyo, Japan

[21] Appl. No.: 509,286

[22] Filed: Jul. 31, 1995

[30] Foreign Application Priority Data

Aug. 3, 1994 [JP] Japan ..... 6-182499
Dec. 14, 1994 [JP] Japan ..... 6-310192

[51] Int. Cl.[6] ..... H01J 3/02

[52] U.S. Cl. ..... 250/423 F; 250/423 R; 313/336; 313/346 R

[58] Field of Search ..... 250/423 R, 423 F; 313/336, 346 R

[56] References Cited

U.S. PATENT DOCUMENTS

| | | | |
|---|---|---|---|
| 3,809,899 | 5/1974 | Baker et al. | 250/423 F |
| 3,814,975 | 6/1974 | Wolfe et al. | 313/336 |
| 4,055,780 | 10/1977 | Kawai et al. | 313/346 R |
| 4,324,999 | 4/1982 | Wolfe | 313/336 |
| 4,379,250 | 4/1983 | Hosoki | 313/336 |
| 4,528,474 | 7/1985 | Kim | 313/346 R |
| 5,449,968 | 9/1995 | Terui et al. | 313/336 |

FOREIGN PATENT DOCUMENTS

| | | |
|---|---|---|
| 59-18540 | 1/1984 | Japan . |
| 60-79636 | 5/1985 | Japan . |
| 60-501581 | 9/1985 | Japan . |
| 2-27643 | 1/1990 | Japan . |
| 6084451 | 3/1994 | Japan . |
| 85/00071 | 1/1985 | WIPO . |

OTHER PUBLICATIONS

D. W. Tuggle et al, "Emission Characteristics of the ZrO/W Thermal Field Electron Source", Journal of Vacuum Science Technology, vol. B3, No. 1, Jan./Feb. 1985, pp. 220–223.

J. P. Barbour et al, "Determination of the Surface Tension and Surface Migration Constants for Tungsten", Physical Review, vol. 117, No. 6, Mar. 15, 1960, pp. 1452–1459.

*Primary Examiner*—Jack I. Berman
*Attorney, Agent, or Firm*—Fay, Sharpe, Beall, Fagan, Minnich & McKee

[57] ABSTRACT

A Schottky emission cathode has a filament, a needle-shaped piece of single crystal refractory metal which is attached to the filament and has a flat crystal surface at a tip thereof, and an adsorbed layer including at least one kind of a metal other than the single crystal refractory metal on the flat crystal surface. The piece of single crystal refractory metal is heated by passing a current through the filament and electrons are extracted by an electric field applied on a tip of the needle-shaped piece of single crystal refractory metal. The tip of the needle-shaped piece of single crystal refractory metal as a radius of curvature of a value to produce an energy width among electrons extracted from the tip not exceeding a predetermined value when the electric field is sufficient to prevent the flat crystal surface from collapsing during operation of the cathode.

50 Claims, 18 Drawing Sheets

FIG. 17

| DATES | OPERATIONS |
|---|---|
| AUG. 29 | MOUNTING OF A NEW ELECTRON SOURCE INTO AN SEM.<br>START OF EVACUATING THE EQUIPMENT. |
| AUG. 30 | EXTRACTION OF ELECTRON EMISSION.<br>APPLYING OF FACET FORMING PROCESS.<br>STARTING OF NORMAL OPERATION. |
| OCT. 30 | APPLYING OF FACET FORMING PROCESS.<br>STARTING OF NORMAL OPERATION. |
| DEC. 30 | POWER OFF OF THE EQUIPMENT. |
| JAN. 4 | STARTING OF THE EQUIPMENT.<br>APPLYING OF FACET FORMING PROCESS.<br>STARTING OF NORMAL OPERATION. |
| MAR. 4 | APPLYING OF FACET FORMING PROCESS.<br>STARTING OF NORMAL OPERATION. |
| MAY. 4 | APPLYING OF FACET FORMING PROCESS.<br>STARTING OF NORMAL OPERATION. |
| JULY. 4 | APPLYING OF FACET FORMING PROCESS.<br>STARTING OF NORMAL OPERATION. |
| SEPT. 4 | REPLACING OF THE ELECTRON SOURCE. |

SCHOTTKY EMISSION CATHODE AND A METHOD OF STABILIZING THE SAME

BACKGROUND OF THE INVENTION

The present invention relates to a cathode, an electron beam apparatus, and a method of stabilizing the cathode used in electron beam application apparatus such as an electron beam lithography system and an electron microscope. Particularly, the present invention is related to shape of a tip of a cathode, a method of manufacturing the cathode, and a method of operating the cathode, which provide electron emission that is stable for a long period of time and uniform in teams of the energy among the electrons.

There has been practically used a Schottky emission cathode which has on a surface of its single crystal tip made of a refractory metal such as W and Mo, a metallic atom whose work function is lower than that of the single crystal tip, for example, Zr, Ti, or Hf and oxygen, of about one atomic thickness, respectively, adsorbed. U.S. Pat. No. 3,814,975 discloses that this emission cathode is fabricated by welding a single crystal piece with its tip sharpened by electrochemical etching on the top of a hairpin-shaped W filament, attaching hydride powder such as Zr hydride near the welded point, and heat-treating it in a vacuum atmosphere having a partial pressure of oxygen gas. A case that such a cathode is used at a high temperature of 1500 K. or more is particularly called a Schottky emission state. The basic structure of this cathode is shown in FIG. 1. Numeral 1 indicates a single crystal tip of W(100), 2 a hair pin type filament of W polycrystals, 4 terminals of stainless steel to which the filament 2 is spot-welded, and 5 a ceramic insulator. The cathode is structured so that a reservoir of oxide 3 such as Zr oxide, the work function of which is lower than that of the single crystal tip 1 of tungsten, is attached on the center or base of the single crystal tip 1 or on the filament 2. When it is heated at about 1500 K. to 1900 K., the oxide is thermally diffused along the single crystal tip 1. The metal oxide diffused toward the end of the single crystal tip 1 is adsorbed at the end of the single crystal tip 1 forms a layer of about one atom thickness of each of oxygen and the metal. The metal oxide is selectively adsorbed on a specific W(100) crystal surface having high activation energy of surface diffusion and desorption. When the W(100) crystal surface is formed at the end of the single crystal tip 1, only the end of the single crystal tip 1 can be kept in the state of a low work function. As a result, a high current density of electron emission can be obtained from that portion. Such a Schottky emission cathode, Zr/O/W is disclosed in Journal of Vacuum Science Technology, B3(1), 1985, p 220 et seq.

This cathode is characterized in that the energy width among emitted electrons is narrow and it can be operated continuously for several thousands hours unlike a normal thermionic emission cathode.

A method of processing an electron beam cathode for obtaining stable electron emission by this kind of cathode is disclosed in U.S. Pat. No. 4,324,999 and a method of stabilizing a cathode having lost stability in its operation is disclosed in Japanese Patent Application Laid-Open Hei 2-27643. These documents disclose the existence of a flat crystal face (hereinafter called a facet) at the tip of a cathode as a condition for obtaining stable electron emission. As a method of forming it, heating the cathode in oxygen is disclosed in U.S. Pat. No. 4,324,999 and applying a strong electric field on the cathode for a short time is disclosed in Japanese Patent Application Laid-Open Hei 2-27643.

Furthermore, operating conditions for this kind of cathode are disclosed in Japanese Patent Application Laid-Open Sho 60-501581. In this patent, it is stated that to prevent the tip of a cathode from blunting due to surface diffusion and to maintain current emission stably, it is necessary to apply an electric field over a certain value on the tip of the cathode and exert an electrostatic force acting toward the tip from the base.

Formulation of the balance between the surface diffusion and the attraction toward the tip from the base which is applied on the tip of a cathode by the electric field is disclosed in Physical Review, Volume 117, Number 6, p 1452 et seq. This paper reports experimental results on a simple W cathode, but not on a Schottky emission cathode. The methods described in U.S. Pat. No. 4,324,999 and Japanese Patent Application Laid-Open Hei 2-276643 require more than several hours for forming a facet, generally about 10 hours.

SUMMARY OF THE INVENTION

The stability of a cathode, a spread of energy among emitted electrons (energy width), and a current density are all important characteristics determining the performance of an electron beam application apparatus such as an electron microscope and an electron beam lithography system. Generally in a Schottky emission cathode, when the strength of an electric field for extracting electrons is increased, although the stability is improved, there is a tendency that the energy width among emitted electrons increases and the current density increases unnecessarily. When the energy width widens, the electron beam cannot be focused finely. When the current density increases excessively, a problem of damage to an object or a sample or contamination arises. As mentioned above, conditions satisfying both the stability requirement and an optimum condition for energy width and current density at the same time have not been studied in the past.

An object of the present invention is to provide a cathode which has an energy width among emitted electrons within the required range and can produce stable electron emission for many hours. Another object of the present invention is to provide an electron beam apparatus which can maintain stable electron emission from a cathode apparatus and determine and set an electron extraction voltage for producing electron emission in the required energy width. Still another object of the present invention is to provide a method of completing facet formation necessary for stable emission of an electron beam from the cathode in a short time.

According to an embodiment of the present invention, the above objects are achieved by optimization of a radius of the tip of the cathode by taking into consideration an electric field appropriate for balancing the electrostatic force with the blunting of the tip of the cathode by surface diffusion and electric field strength to provide electron emission having a desired energy width among emitted electrons, in a cathode comprising a piece of single crystal refractory metal attached on a tip of a filament and an adsorbed layer of metal having work function or electron affinity lower than that of the single crystal and formed on a tip of the single crystal piece, wherein the single crystal piece is heated by a current passing through the filament to a temperature which stably builds up and maintains the adsorbed layer, and an appropriate electric field is applied on the tip of the single crystal piece, to extract electrons from the tip of the single crystal piece.

Furthermore, according to another embodiment of the present invention, the above objects are achieved by an electron beam apparatus comprising a cathode for providing such stable electron emission having a narrow energy width, a power supply for heating the cathode, an extraction power supply for forming an electric field for extracting electrons from the cathode, an accelerating power supply for accelerating the emitted electrons from the cathode, and a control computer for controlling the extraction power supply wherein the control computer determines and sets an extraction voltage for forming an electric field sufficient for maintaining stable electron emission and appropriate for producing electron emission of a narrower energy width than a required value at the tip of the needle-shaped piece of single crystal of the cathode.

Furthermore, according to still another embodiment of the present invention, the above objects are accomplished by a method of forming a facet essential for stable emission of an electron beam at the tip of the cathode comprising the steps of removing the metal adsorbed layer first at the tip of the single crystal piece of the cathode by evaporation by heating, next continuing to apply an electric field for preventing the tip from blunting due to migration of the atoms form the tip of the single crystal piece until the electron emission current increases and a uniform circular electron emission pattern appears or the electron emission current saturates.

Furthermore, according to a further embodiment of the present invention, the above objects are accomplished, in an electron beam apparatus comprising a cathode, a power supply for heating the cathode, an extraction power supply for forming an electric field for extracting electrons from the cathode, an accelerating power supply for accelerating electrons emitted from the cathode, and a control computer for controlling the three power supplies, wherein electrons extracted from the cathode are focused by a lens having an aperture plate (a stop) and illuminate a sample, by detecting an electron current absorbed by the aperture plate, inputting the current value to the control computer, and controlling the heating power supply and the extraction power supply on the basis of the absorbed electron current.

BRIEF DESCRIPTION OF THE DRAWINGS

FIG. 17 shows an example of an operating diary of a critical dimension measurement scanning electron microscope with a cathode of an embodiment of the present invention.

DETAILED DESCRIPTION OF THE PREFERRED EMBODIMENTS

Figure 2:
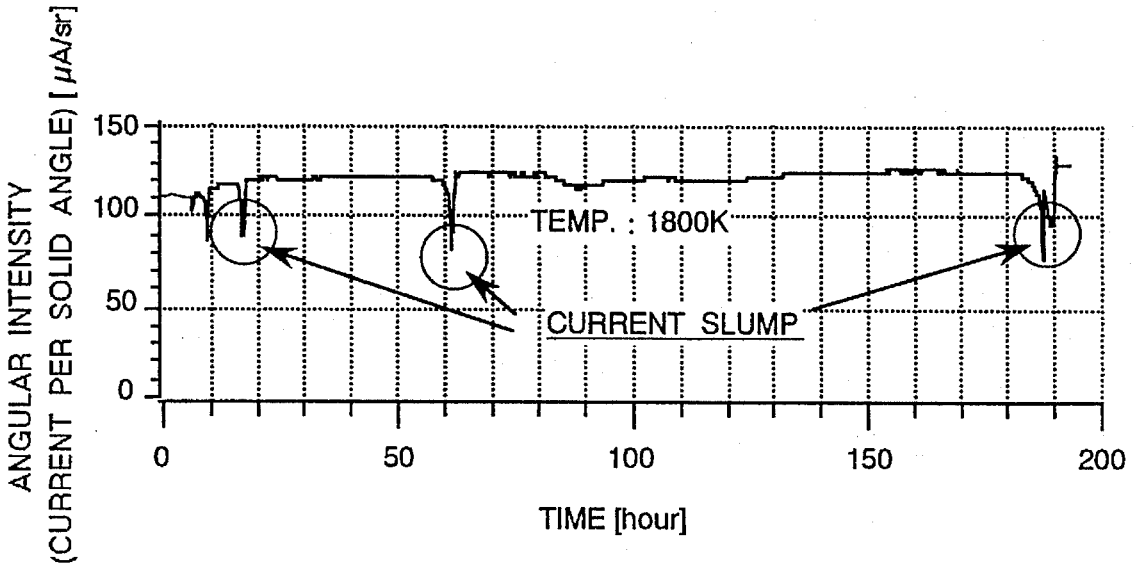
FIG. 2 is a figure showing a change with the passage of time of a density of emission current when a conventional cathode is operated by a conventional operating method.

If a cathode is operated continuously for more than several hundreds of hours, even after having a flat crystal surface (100) formed at its tip and having started to operate stably, the flat crystal surface (100) collapses little by little and its emission current often drops off abruptly again after it having operated stably for a limited time. The phenomenon is shown in FIG. 2. The probe current is monitored for many hours and the current density decreases by more than 30% every 50 hours to 100 hours. When such a decrease in electric current occurs abruptly, if the cathode is mounted in an electron microscope, for example, the quality of microscopic images deteriorates. Particularly when unattended automatic measurements are made for evaluation of semiconductor process, the reliability of evaluation results may be decreased extremely.

This phenomenon occurs due to collapse caused by imbalance between migration of atoms from the tip of the cathode at a high temperature (about 1800 K.) and the electrostatic force by the electric field. To prevent it, it is effective to strengthen the electric field as described in Japanese Patent Application Laid-Open Sho 60-501581. However, although this method can suppress changes in the current, the energy width among emitted electrons increases up to about 1 eV as an unfavorable side effect. In this case, the energy width means a half value width in an energy distribution among emitted electrons. When the energy width among emitted electrons increases, it is difficult to focus an electron beam finely.

Particularly in an electron microscope using an electron beam of low energy, the energy width is an important factor in performance of the electron microscope. In a critical dimension measurement scanning electron microscope (hereinafter called a CDSEM) for evaluation of LSI process, an accuracy of about 8 nm is required in the image resolving power and repeatability in measurement in consideration of the dimensional accuracy required for the LSI process. Furthermore, to prevent damage to, or charge-up of LSI's as an object, it is necessary to limit the energy of an electron beam to about 1 keV.

Figure 3:
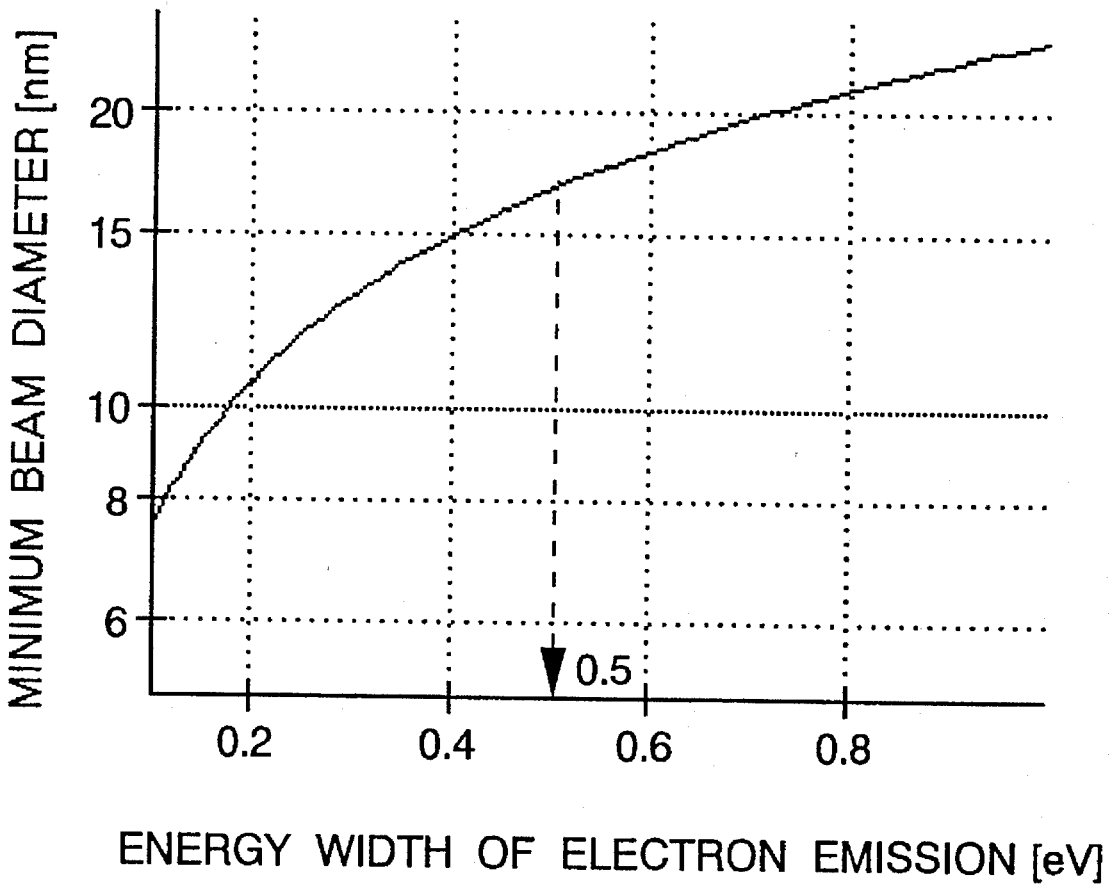
FIG. 3 is a figure indicating a relationship between the energy width among emitted electrons and the minimum beam diameter of emitted electrons.
Figure 4A:
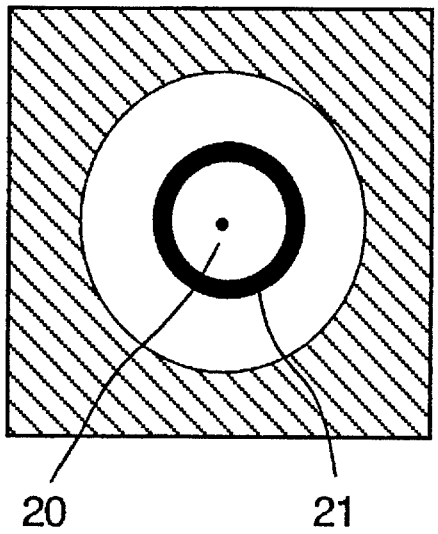
FIGS. 4(*a*) and 4(*b*) show electron emission patterns and FIGS. 4(*c*) and 4(*d*) are perspective views of the tip of a cathode corresponding to FIGS. 4(*a*) and 4(*b*).
Figure 4B:
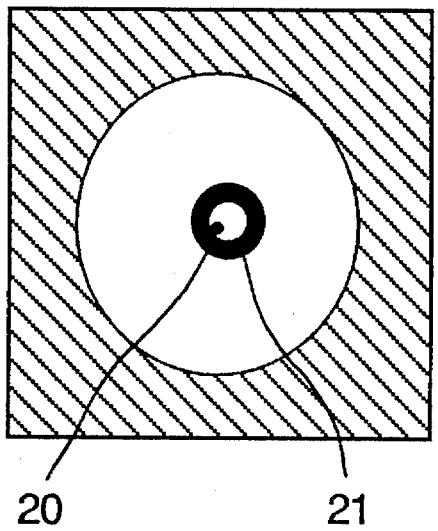
Figure 4C:
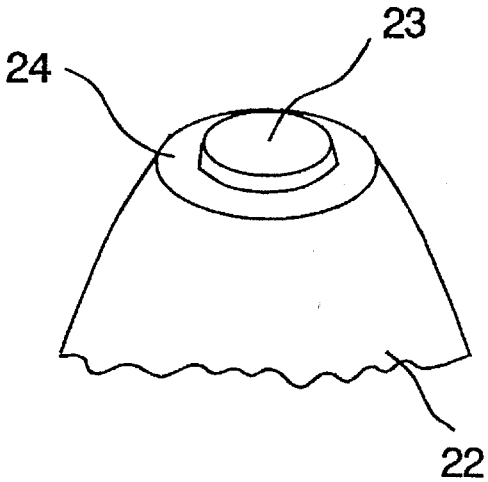
Figure 4D:
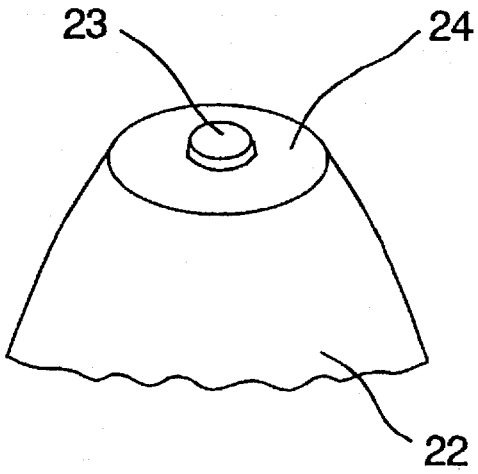

FIG. 3 indicates a relationship between the energy width and the minimum beam diameter of a 1 keV electron beam. The minimum beam diameter is determined from a condition under which the sum of squares of chromatic aberrations and diffraction aberrations is minimized. In this calculation, a value of 6 mm, a value below which is considered to be impossible for an electron lens for a CDSEM to attain, is used as a coefficient of chromatic aberration. The image resolving power is about a half of the beam diameter, so that to obtain an image resolving power of 8 nm, it is necessary that the energy width is 0.5 eV or less corresponding to the beam diameter of about 16 nm.

As mentioned above, it is found that when only the electric field strength is increased so as to obtain stable electron emission, the energy width increases to more than 0.5 eV and it poses a problem. Furthermore, a problem arises that when only the electric field strength is increased, the density of emission current increases unnecessarily. In this case, when a device for obtaining an enlarged image of an object such as a scanning electron microscope or a transmission electron microscope is used, damage to or contamination of an object increases.

First, an unstable operation of a cathode occurring when the electric field strength is small, and the mechanism thereof, will be explained briefly with reference to FIGS. 4(*a*) to 4(*d*). FIGS. 4(*c*) and 4(*d*) are perspective views of the tip of a Zr/O/W cathode using a single crystal W 22 of the <100> crystal orientation and illustrated based upon the observation with a scanning electron microscope. A flat portion 23 at the tip and a second flat portion 24 are W(100) crystal surfaces and these portions are called a facet. The electron emission patterns shown in FIGS. 4(*a*) and 4(*b*) are obtained by locating a metal plate coated with phosphor in an opposed relationship to a cathode, extracting an electron beam from the cathode by applying an electric field between the cathode and the metal plate, and bombarding the phosphor on the metal plate with the electrons to exhibit fluorescence. Therefore, the brighter fluorescent portion indicates it is bombarded with a current of the higher current density. The hatched portions and dark rings shown in FIGS. 4(*a*) and 4(*b*) indicate less fluorescent portions. A black point 20 at the center of each of the electron emission patterns corresponds to an aperture made in the metal plate coated with phosphor for measuring a current therethrough.

When the attraction along the needle's axis toward the tip from the base due to the electric field decreases compared with the surface diffusion and their balance becomes lost, atoms at the peripheral portions of the facet on the W(100) crystal surface at the tip diffuse on the surface toward the base of the tip and the facet on the W(100) surface collapses and becomes gradually smaller. When the W(100) crystal surface 23 becomes smaller, a new W(100) crystal surface appears instead. The step-like shoulder between the two W(100) crystal surfaces corresponds to the ring-shaped black portion 21 appearing in each of the emission patterns shown in FIGS. 4(*a*) and 4(*b*) where very few electrons are emitted. When the step-like shoulder moves and crosses the aperture 20, an abrupt decrease occurs in the probe current.

As described in connection with the prior art, if the extraction voltage is increased for electron emission from the Schottky emission cathode, the blunting of the tip due to surface diffusion is suppressed by the resultant increase in electrostatic force and the collapse of the facet at the tip of the cathode stops and the aforementioned change in current is eliminated. On the other hand, the energy width among electrons increases when the extraction voltage is increased. To examine this relationship quantitatively, the extraction voltage at which the collapse of the facet stops is obtained experimentally and the energy width among emitted electrons at the extraction voltage is measured. The extraction voltage at which the collapse of the facet stops is obtained from the following experiment. First, the probe current is monitored for many hours at various extraction voltages and the period in which an abrupt decrease in the probe current occurs is measured.

Figure 5:
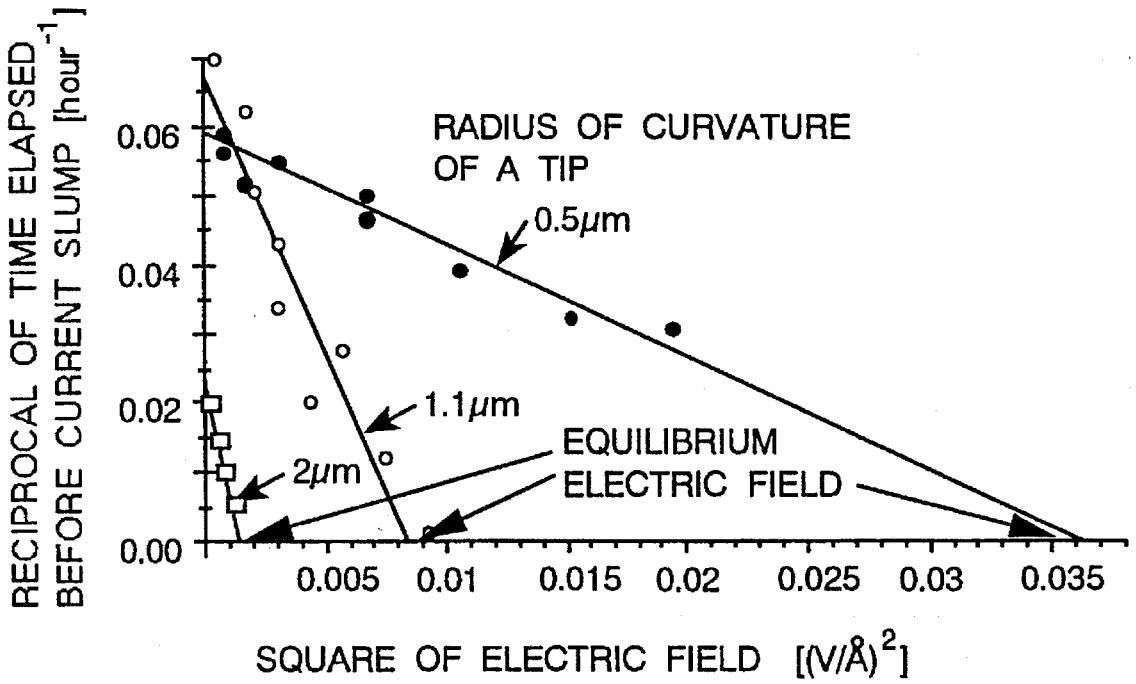
FIG. 5 is a figure indicating a relationship between the time elapsed before a decrease in electric currents occurs and the electric field strength.

Next, the electric filed strength F which is calculated from the extraction voltage by using the following Formula 1 is indicated on the abscissa and a reciprocal of the period of abrupt decrease in the probe current is indicated on the ordinate as shown in FIG. 5.

$$F = A\frac{2V}{r\cdot\ln\left(\frac{2d}{r}\right)} \tag{1}$$

where d is a distance from the tip of the cathode to the extraction electrode, r is a radius of curvature of a longitudinal cross section of the tip of the cathode, V is an extraction voltage, and A is a coefficient indicating the effect of the suppresser electrode and is nearly 1 on the basis of the calculation of electric fields and experimental results.

The radii of curvature of the tip of the cathode used for experiments are large values from 1 to 2 μm which have never been used generally in addition to 0.5 μm which is generally used. FIG. 5 shows results on radii of curvature of 0.5, 1.1, and 2 μm among them. The experimental results are plotted on nearly straight lines for the respective radii of curvature. The electric field strength at which an abrupt decrease in the probe current does not occur is one at which a reciprocal of a period at which an abrupt decrease occurs becomes zero. Therefore, when the straight lines of the plots obtained from the experimental results are extrapolated to intersect the abscissa, intercepts on the abscissa indicate the electric field strength at which no abrupt decrease in the probe current occurs, that is, the electric field strength for maintaining a facet.

Next, the energy distribution among emitted electrons was measured for electric field strengths obtained above. The energy width among electrons from a cathode having a radius of curvature of 0.5 μm of a longitudinal cross section of a tip (a radius of curvature of a longitudinal cross section of a tip shall be hereinafter sometimes called a radius of curvature of a tip for short) turned out to be larger than 0.7 eV for an application at the cathode of an electric field required for maintaining a facet. On the other hand, the present inventors found out that the energy width among electrons from a cathode having a larger radius of curvature of a tip which had never been tried before was smaller than 0.5 eV for an application at the cathode of an electric field required for maintaining a facet.

In the Schottky emission cathode, such a large radius of curvature of a tip has not been used. The reason is that the Schottky emission cathode has been started from improvement of a high brightness field emission cathode and an extreme increase in the radius of curvature which decreases the brightness has not been tried. However, when the above-mentioned actual experiments showed that if the radius of curvature of a tip of a cathode was limited to less than about 2.5 μm, an extreme decrease in brightness was not observed and the brightness was sufficiently within a practical range.

Figure 6:
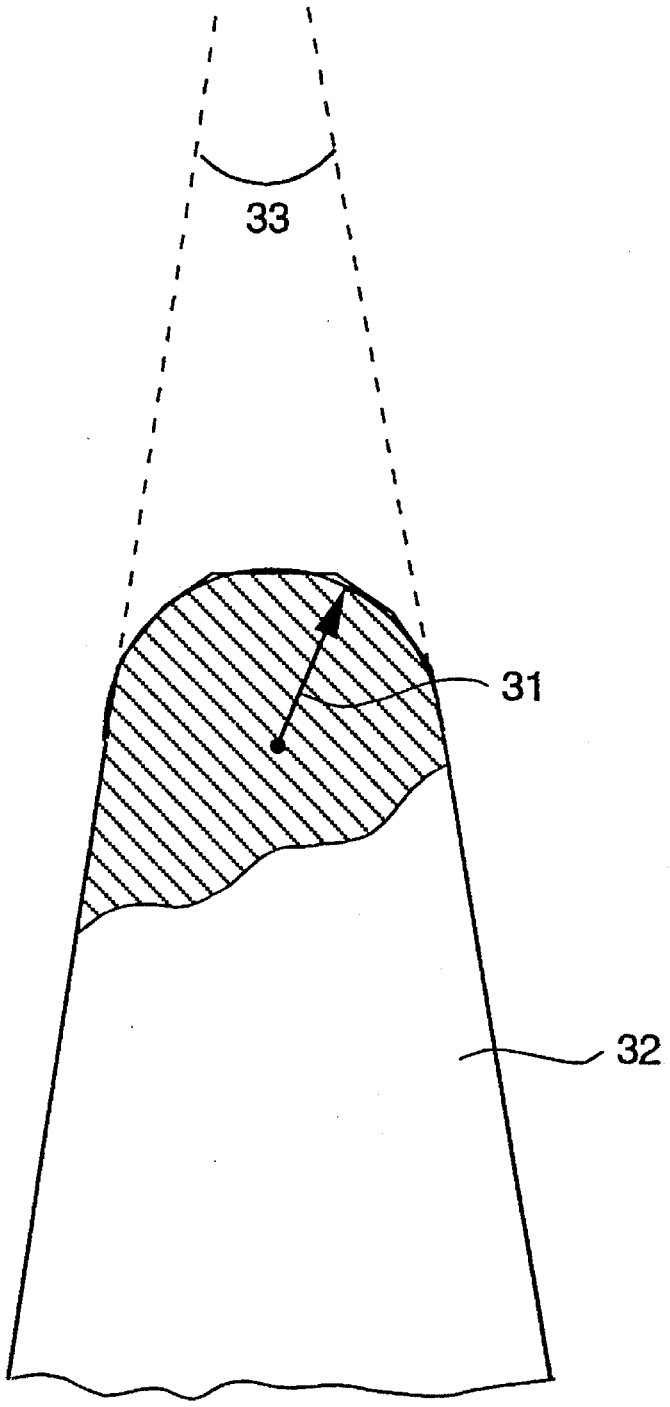
FIG. 6 is a longitudinal cross sectional view of the tip of a cathode illustrating the definitions of the radius of curvature and the cone angle of the tip of the cathode.

It was found out that when the radius of curvature of a tip is more than 1.1 μm, even if an extraction voltage which can maintain a facet is applied, there exists a condition under which the energy width among emitted electrons is less than 0.5 eV. The radius of curvature of the tip of a cathode is defined as a radius 31 of a semisphere with which a curved surface of a tip of a cathode is approximated by using a least squares method in a longitudinal cross sectional view of the tip of a cathode shown in FIG. 6. There exists a portion 32 of the shape of a frustrum of a cone between the base of the single crystal W and the semispherical portion of the tip. An angle 33 included by the envelop of this frustrum of a cone is called a cone angle. Details of the aforementioned results will be described in embodiments described later. It was confirmed experimentally that when the radius of curvature is increased, even if an extraction voltage sufficient for maintaining a facet is applied, the energy width among emitted electrons can be narrowed. The reason can be explained as follows:

The relationship relating to balance between the surface diffusion and the electrostatic force at the tip of a cathode is expressed by Formula 2.

$$\left(\frac{dZ}{dt}\right)_F = \left(1 - \frac{1}{C_0}\ \frac{rF^2}{16\pi\gamma}\right)\left(\frac{dZ}{dt}\right)_0 \tag{2}$$

where: γ is a surface tension,

F is an electric field strength, $C_0$ is a coefficient depending on the shape of the tip and nearly 0.5, and r is a radius of curvature of the tip (Physical Review, Volume 117, Number 6, page 1452 et seq.). dz/dt indicates a speed at which the tip of the cathode is shortened. The suffix 0 indicates a speed at which the tip is shortened only by surface diffusion when the electric field is 0. The suffix F indicates a speed when the electrostatic force is taken into account. Therefore, when the value of this formula is zero, it means that the surface diffusion and the electrostatic force are balanced. An electric field strength F0 (hereinafter called an equilibrium electric field strength) at which such a condition is satisfied is obtained from Formula 3.

$$F_0 = \sqrt{\frac{8\pi\gamma}{r}} \tag{3}$$

This formula indicates that as the radius of curvature of a longitudinal cross section of a tip r increases, the equilibrium electric field strength F0 decreases. However, since a variation in surface tension according to the crystal orientation and a change in surface tension when Zr is adsorbed at the tip are not taken into account, it is a completely qualitative formula.

On the other hand, the energy width among emitted electrons narrows generally as the radius of curvature of a longitudinal cross section of a tip increases. The reason is that when the radius of curvature of a longitudinal cross section of a tip increases, the area of the electro-emissive portion increases and a space charge effect (called the Boersch effect) increasing the energy width among emitted electrons decreases.

In summary, since the equilibrium electric field strength decreases as the radius of curvature increases, even if an electric field higher than the equilibrium electric field strength is applied to obtain a stable electron emission free from collapse of a facet, the energy width can be narrowed sufficiently. However, as the radius of curvature increases, it becomes harder to extract an emission current. Therefore, to obtain a practical current density, it is necessary to limit the radius of curvature to less than 2.5 μm.

Next, concrete embodiments will be described.

Figure 7:
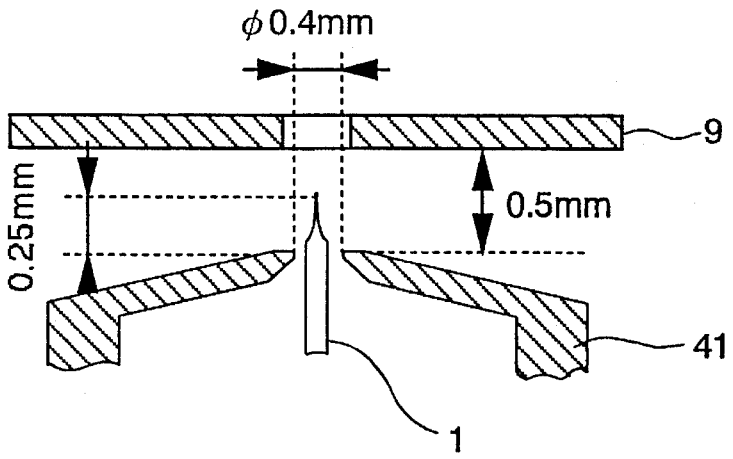
FIG. 7 is a cross sectional view of the electrode portion of an electron beam apparatus of an embodiment of the present invention.

By using cathodes having zirconium and oxygen adsorbed at the tip of a needle-shaped piece of single crystal tungsten of crystal orientation <100>, conditions required for a stable operation with energy width of less than 0.5 eV are experimentally obtained for various radii of curvature of the longitudinal cross section of the tip. FIG. 7 shows a structure of the tip of the cathode used in the experiments and an anode for extracting electrons. The tip of the cathode comprising single crystal tungsten 1 of orientation <100> is projected from the aperture of 0.4 mm in diameter made at the center of a suppressor electrode 41 by 250 μm. The suppressor electrode 41 is an electrode for preventing unnecessary thermoelectrons from emitting from the base of the cathode and is supplied with a negative potential between 300 and 800 V with respect to the single crystal 1. An anode 9 for extracting electrons is located at a distance of 0.5 mm from the suppressor electrode 41 and is supplied with a high positive voltage with respect to the single crystal 1. In this specification, this voltage is referred to as an extraction voltage. Cathodes of this construction were studied for various radii of curvature of a longitudinal cross section of a tip. All cone angles of evaluated tips of needle-shaped pieces of single crystal tungsten of orientation <100> were less than 30°. The cone angle is the angle defined by 33 shown in FIG. 6.

In the experiments, by measuring a relationship between the extraction voltage and the energy width among emitted electrons was measured, and also by monitoring the current density of emitted electrons for many hours, and lowest extraction voltages required for producing stable electron emission without large decrease in the probe current and with the change rate of probe current being less than 5% per hour were obtained. These voltages were obtained from minimum electric field strengths which can maintain a facet by using FIG. 5. These shall be called equilibrium extraction voltages. These are extraction voltages forming minimum electric fields (equilibrium fields, that is, F0 in Formula 3) necessary to maintain a facet at the tip of a cathode.

Figure 8:
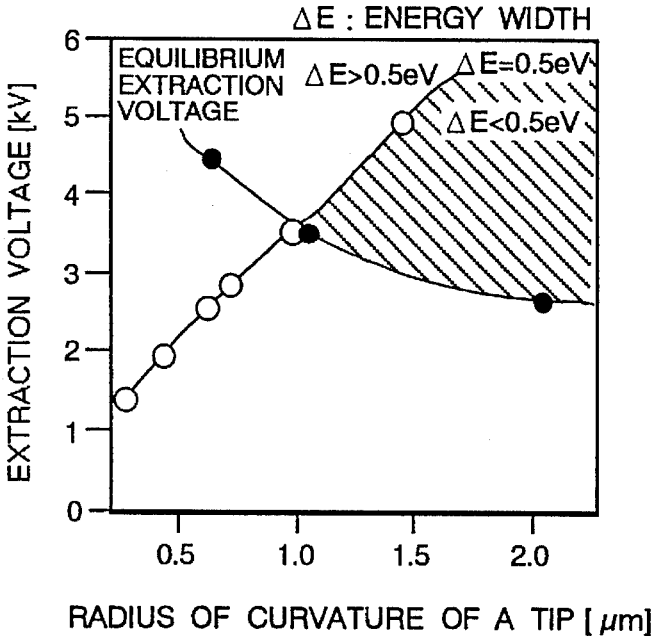
FIG. 8 is a figure indicating a relationship between the radius of curvature of the tip of a cathode and the equilibrium extraction voltage and a relationship between the radius of curvature of the tip of the cathode and the extraction voltage at which the energy width among emitted electrons becomes constant.

The experimental results are shown in FIG. 8 as a radius of curvature of a longitudinal cross section of a tip vs. an equilibrium extraction voltage and a radius of curvature of a longitudinal cross section of a tip vs. an extraction voltage providing the energy width of 0.5 eV. The figure shows that as the radius of curvature increases, the equilibrium extraction voltage decreases slightly. On the other hand, the extraction voltage providing the energy width of 0.5 eV increases as the radius of curvature increases. Therefore, the curve of the equilibrium extraction voltage intersects with that of a constant energy width at a certain radius of curvature. The curve of the extraction voltage providing the energy width of 0.5 eV intersects with that of the equilibrium extraction voltage at the radius of curvature of 1.1 μm.

When the radius of curvature is larger than 1.1 μm, even if a voltage higher than the equilibrium extraction voltage is applied, there exists a region in which the energy width among emitted electrons is less than 0.5 eV. In FIG. 8, this region is indicated by a hatched area. For example, the extraction voltage between 3.0 kV and 5 kV is effective for the radius of curvature of a tip of 1.5 μm and the extraction voltage between 2.6 kV and 6 kV for the radius of curvature of 2 μm.

Figure 9:
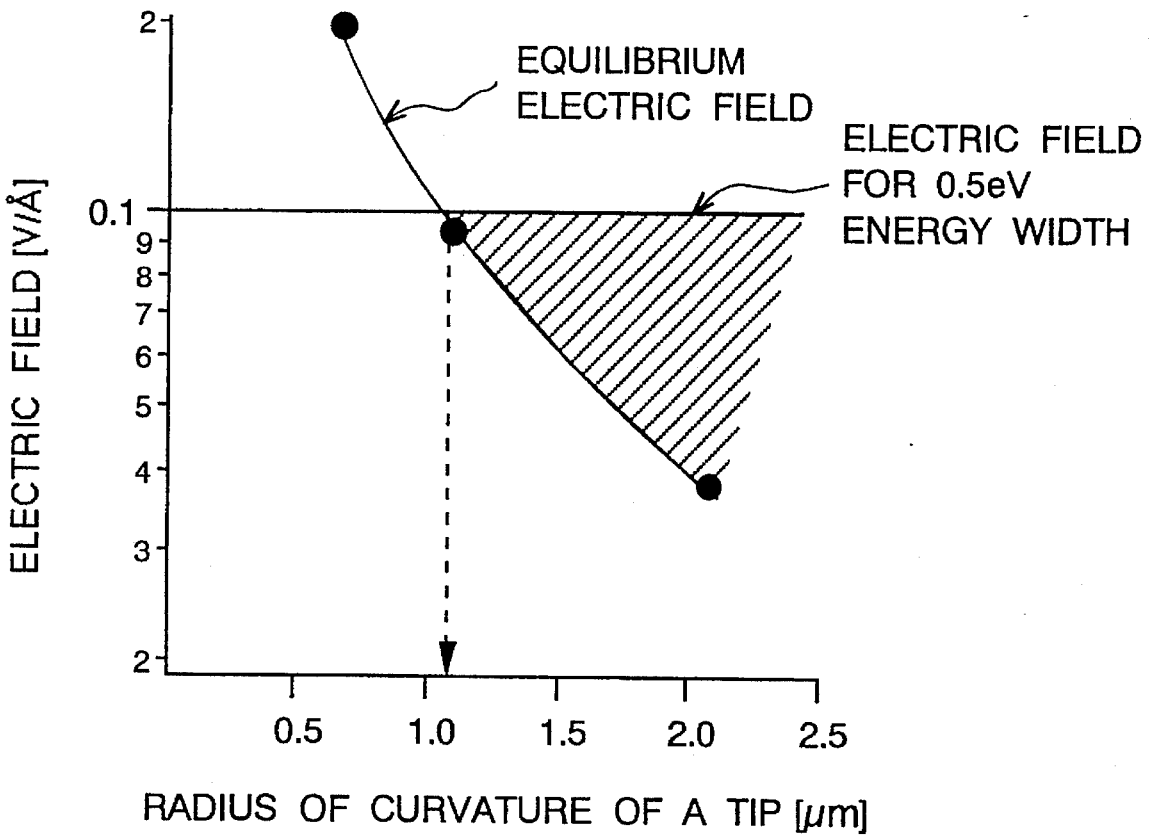
FIG. 9 is a figure indicating a relationship between the radius of curvature of the tip of a cathode and the equilibrium extraction electric field and a relationship between the radius of curvature of the tip of the cathode and the extraction electric field in which the energy width among emitted electrons becomes constant.

In the aforementioned embodiment, extraction voltages are provided for a specific electrode geometry. However, for the purpose of further generalization, it is necessary to convert them into electric field strengths applied on the tip of the cathode. The electric field strength is calculated from Formula 1 mentioned above, and FIG. 9 shows the values on the ordinate shown in FIG. 8 converted into electric field strengths. As in FIG. 8, the figure shows that to obtain electron emission with an energy width of less than 0.5 eV, it is desirable to use a cathode having a larger radius of curvature of a longitudinal cross section of a tip than 1.1 μm. For example, it is desirable to apply an electric field strength between 0.051 V/Å and 0.1 V/Å, for the radius of curvature of a longitudinal cross section of a tip of 1.5 μm and an electric field strength between 0.041 V/Å and 0.1 V/Å for the radius of curvature of 2 μm.

In the above embodiments, cathodes having Zr and O adsorbed to single crystal tungsten of orientation <100> is described. However, a tendency could be confirmed that even if different materials are used, as the radius of curvature increases, the energy width decreases for an extraction voltage higher than the equilibrium electric field. For example, in a cathode having Y and O adsorbed to single crystal tungsten of orientation <100>, when the radius of curvature of a longitudinal cross section of a tip is more than 0.9 μm, the curve indicating the equilibrium field strength intersects with that indicating an electric field providing the energy width among emitted electrons of 0.5 eV. For example, when the radius of curvature is 1.2 μm and the electric field strength is between 0.068 V/Å and 0.081 V/Å, the cathode operates stably with an energy width among emitted electrons of less than 0.5 eV.

To sum up, for stable electron emission with an energy width smaller than desired, it is desirable to use a cathode having a radius of curvature larger than a specific value within a range of a specific electric field strength.

Next, a method of forming a needle-shaped piece of single crystal having a large radius of curvature of a longitudinal cross section of a tip as mentioned above will be described. First, as in forming of a usual field emission type cathode, a piece of single crystal of tungsten is shaped into a needle by electrochemical etching. In this case, the needle-shaped tip has a very sharp tip having a radius of curvature of less than 0.1 μm and its cone angle is about 15°. To blunt the tip of the cathode, it is desirable to heat the tip. By enlarging the cone angle of the tip before the heating process, a desired radius of curvature can be obtained at a low heating temperature in a short time. To enlarge the cone angle, it is desirable to electrochemically etch the needle-shaped piece of single crystal further by an AC voltage.

Figure 10:
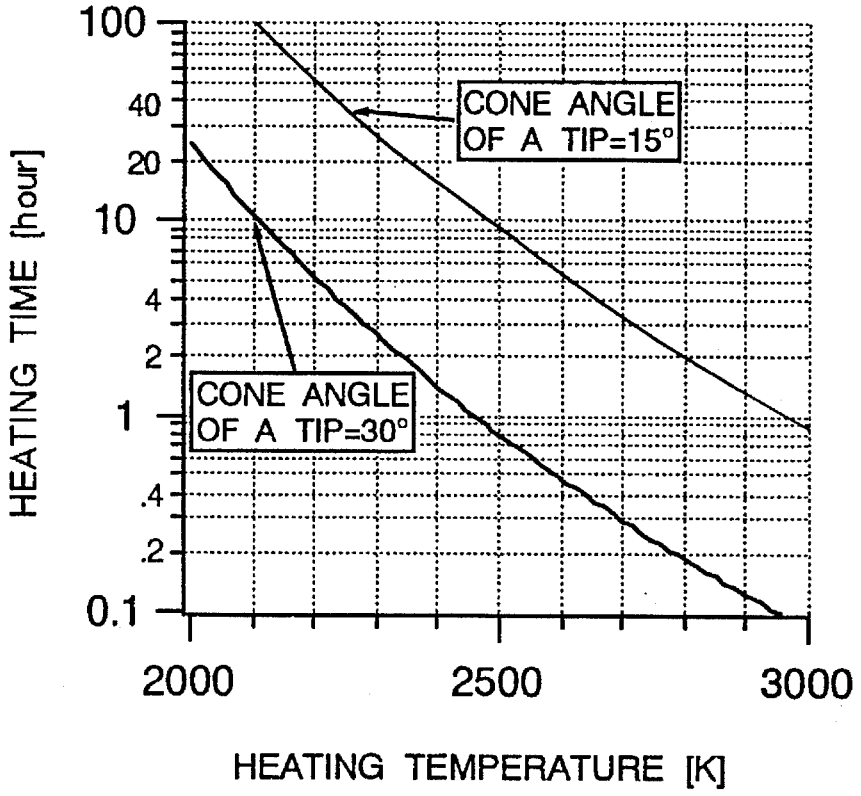
FIG. 10 is a figure indicating a relationship between the heating temperature and the heating time for forming a tip of a cathode having a radius of curvature of 1.1 μm or more.

FIG. 10 shows a relationship between the temperature and heating time necessary for forming a radius of curvature of 1.1 μm or more. The figure shows two cases, one where a cone angle is enlarged to 30° by AC electrochemical etching and another where a cone angle is not enlarged. When the cone angle is 30°, relationships between the heating temperature and heating time necessary for forming a radius of curvature of 1.1 μm were for more than five hours at 2200 K., for more than 0.5 hours at 2600 k., or for more than 0.2 hours at 2800 K.. When the cone angle is 15°, relationships between the heating temperature and heating time were for more than 50 hours at 2200 K., for more than 5 hours at 2600 K., or for more than 2 hours at 2800 K.

Figure 11A:
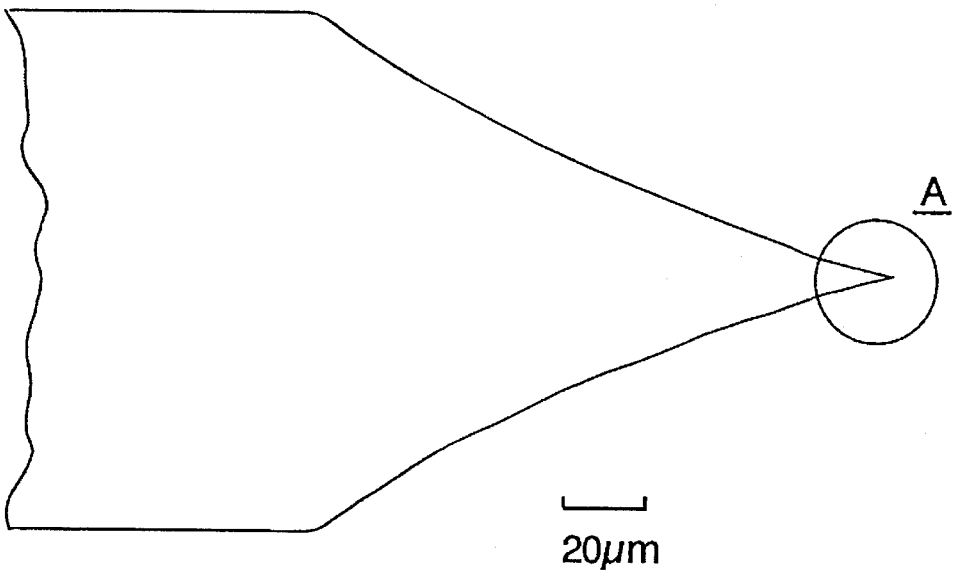
FIG. 11(*a*) is a side view of the tip of a cathode of another embodiment of the present invention and FIG. 11(*b*) is an enlarged view of the portion designated A thereof.
Figure 11B:
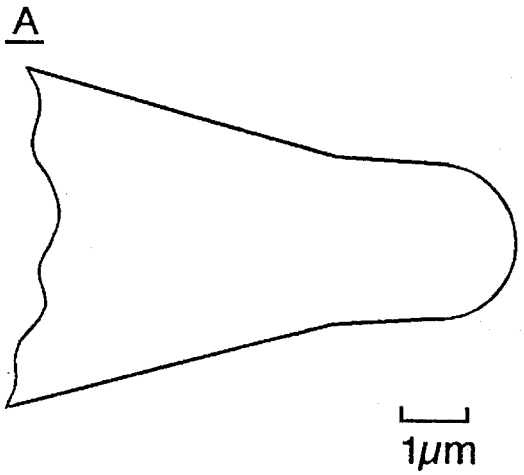
Figure 12A:
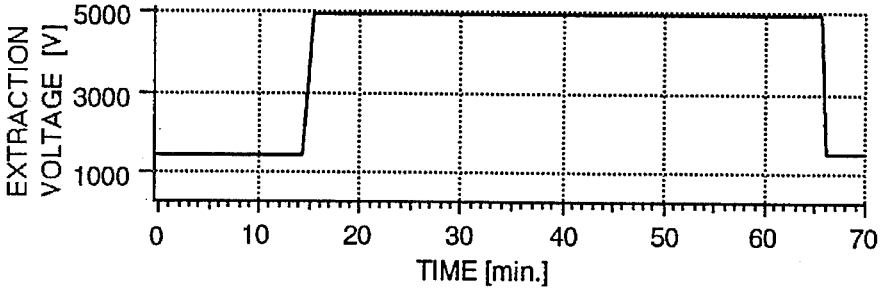
FIGS. 12(*a*), 12(*b*), 12(*c*), and 12(*d*) are figures indicating extraction voltage vs. time, tip temperature of a cathode vs. time, angular current intensity vs. time, and electron emission current vs. time respectively in a method of forming a facet for a cathode of still another embodiment of the present invention.
Figure 12B:
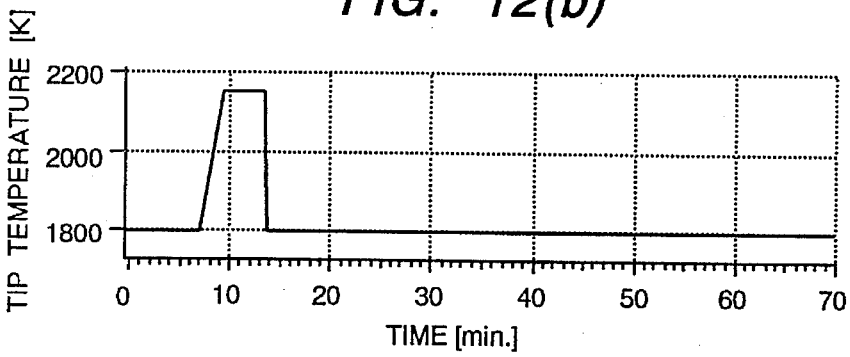
Figure 12C:
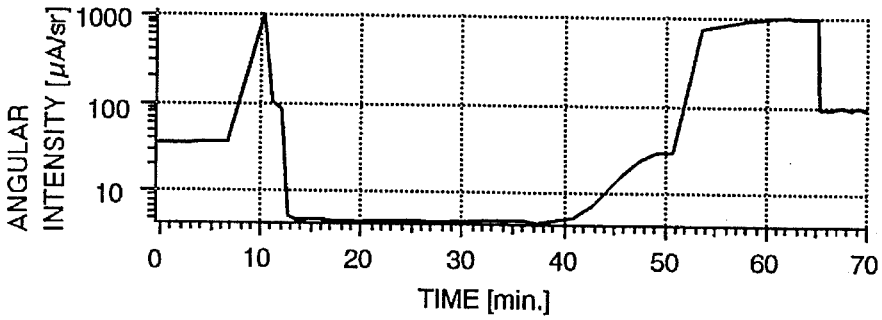
Figure 12D:
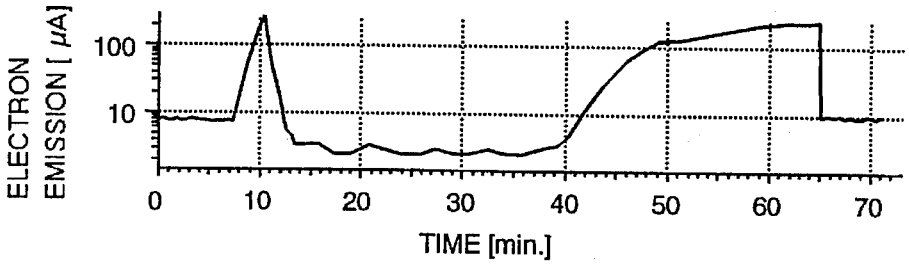

A shape of a tip of a cathode fabricated by the aforementioned method is shown in FIGS. 11(*a*) and 11(*b*). The tip is semispherical, and the radius of curvature is about 1.1 μm, and the cone angle is about 30°. When a tip of a cathode having a cone angle of 40° was fabricated and electrons were extracted from it, the electron emission pattern was elliptical and no facet was formed at the tip, so that the tip did not operate stably.

Next, a method of forming a facet at a tip of a cathode will be explained. When an electric field applied on the tip of the cathode is strong, a so-called build-up phenomenon occurs, and the orientations of the tip of the cathode other than <100>, for example, <111> and <310> grow, and the W(100) surface of the tip becomes larger. Therefore, to form a facet at a tip, it is desirable to apply a strong electric field on it. The time necessary for forming a facet depends on the speed of surface diffusion of W atoms.

In a Schottky emission cathode, a chemical compound of metals such as Zr, Ti, and Hf is adsorbed on the W(100) surface. These adsorbed layers hinder surface diffusion of the tungsten element, so that it requires a longer time to form a facet on the W(100) surface when these adsorbed layers exist. In this embodiment, as a process for forming a facet and fabricating a stable cathode, a method comprising the steps of removing the adsorbed layers of metals such as Zr, Ti, and Hf adsorbed on the tip first so as to expose the W(100) surface and applying a strong electric field is adopted. By using this method, the processing time is shortened remarkably compared with a process with Zr, Ti, and Hf remaining adsorbed.

As an example in which a process for forming a facet at a tip of a cathode is performed by the aforementioned method, time charts of tip temperature of the cathode, extraction voltage, electron emission current, and angular intensity are shown in FIGS. 12(*a*) to 12(*d*), respectively. The angular intensity is a current density per solid angle and nearly in proportion to the probe current. The cathode is a single crystal W(100) to which Zr (zirconium) and O (oxygen) are adsorbed. When the extraction voltage is 1.4 kV and the tip temperature is 1800 K., the emission pattern had a ring-shaped dark portion as shown in FIGS. 4(*a*) and 4(*b*). Therefore, the tip temperature is raised to 2150 K. first. Immediately after the temperature is raised, both of the electron emission current and the angular intensity increased by more than one order of magnitude, but decreased sharply soon, and one or two minutes later the angular intensity decreased to nearly zero and the electron emission current decreased to less than 4 μA, and the emission pattern disappeared. This is a status in which Zr adsorbed at the tip of W(100) was removed by heating at a high temperature and the work function rose. Thereafter, the temperature was returned to 1800 K. and the extraction voltage was increased to 5 kV. When the cathode was left in this status, after about 25 minutes the electron emission current and the angular intensity started to increase and 10 minutes after then the angular intensity increased abruptly by more than one order of magnitude. Thereafter, since the angular intensity and the electron emission current nearly saturated, the extraction voltage was returned to 1.4 kV. The emission pattern at this time was a uniform circle having no dark ring, and it was confirmed that a flat portion of the W(100) surface could be formed at the tip of the cathode, and the facet forming process for the cathode can be completed. A chart of the aforementioned flow is summarized in FIG. 13.

In the aforementioned embodiments, immediately after the tip temperature of the cathode is raised or in the state in which the extraction voltage is left increased until the electron emission current saturates, an electron emission current in excess of one order of magnitude larger than that in the normal operation state flows. Therefore, a problem arises in that it is necessary to provide a power supply for electron extraction having a current capacity in excess of one order of magnitude higher than that for normal operation only for this processing. In the following embodiment, a facet forming method for a cathode by which the above problem is solved and does not require a power supply having a capacity larger than the electron emission current in the normal state will be explained with reference to FIGS. 14(*a*) to 14(*d*).

FIGS. 14(*a*) to 14(*d*) show time charts of extraction voltage, tip temperature of the cathode, angular intensity, and electron emission current respectively. First, from the normal operating conditions that the tip temperature of the cathode is 1800 K. and the extraction voltage is 1.4 kV, the tip temperature of the cathode was increased to 2150 K. When the extraction voltage is fixed in this case, the electron emission current increases abruptly. Therefore, to prevent the electron emission current from exceeding a predetermined value of 10 μA, the extraction voltage was set to zero beforehand simultaneously with rise of temperature. Thereafter, the electron emission current decreased abruptly, and the extraction voltage was increased again up to 1.4 kV. It is desirable that the extraction voltage at this time is nearly a voltage at which thermoelectrons are extracted and it is important that a high extraction voltage at which field emission electrons are emitted is not applied in the state that nothing is adsorbed on the W(100) surface of the tip of the cathode. This voltage may be a voltage within a range from 0.5 to 1.5 kV. The cathode was left in this state until the electron emission current decreases to less than 5 μA. Next, the temperature was set to 1800 K. and the extraction voltage was set to 5 kV. When the electron emission current increased and reached a predetermined value of 10 μA, the extraction voltage was controlled so as to prevent the electron emission current from exceeding the value, and the cathode was returned to the normal operation status (extraction voltage=1.4 kV, tip temperature of the cathode=1800 k.) when the extraction voltage became constant. At this time, a circular electron emission pattern was obtained. It was known from this that the tip was flattened and the facet forming of the cathode was achieved. A chart of the aforementioned process flow is summarized in FIG. 15. In the aforementioned embodiment, the upper limit of the electron emission current is set to 10 μA. However, the value is sufficient if it is more than 5 μA and can be freely set according to the capacity of the power supply. A temperature to which the temperature of the cathode is lowered again after it is heated to more than 1900 K. can be chosen between 1500 to 1850 K.

FIGS. 12(*a*) to 12(*d*) and 13 are time charts and a flow chart when the tip of the cathode was raised to 2150 K. in temperature. However, a temperature equal to or higher than 1900 K. suffices for the purpose. Namely, the temperature is one at which the amount of evaporation of zirconium from the tip is larger than the amount of diffusion of zirconium from its source at the base of the single crystal 1. Concretely, the time required for the electron emission current to decrease to less than 5 μA was 5 minutes when heated to 1900 K., 4 minutes when heated to 1950 K., 3 minutes when heated to 2000 K., and 2 minutes when heated to 2150 K. Therefore, when the cathode is left heated slightly longer than the time indicated above for each temperature, zirconium can be removed from the W(100) surface of the tip of the cathode. FIGS. 12(*a*) to 12(*d*) show a case that the temperature is lowered to 1800 K. thereafter. However, the temperature can be chosen within a range from 1500 K. to 1850 K., that is, a temperature at which the amount of diffusion of zirconium from its source at the base of the single crystal 1 is larger than the amount of evaporation of zirconium from the tip. However, at a temperature lower than 1700 K., it requires many hours for the electron emission current and the angular current intensity to rise, and a temperature of about 1800 K. is optimum.

In this embodiment, the extraction voltage is 5 kV. The corresponding extraction electric field depends on the radius of curvature of the longitudinal cross section of the tip of the cathode and the distance between the tip of the cathode and the extraction electrode. The electric field strength F is 0.2 V/Å by calculation of Formula 1 substituting the above-mentioned values for the extraction voltage V, the radius r of curvature of the longitudinal cross section of the tip of the cathode, and the distance d between the tip of the cathode and the extraction electrode. The experimental results for various extraction voltages and inter-electrode distances indicated that when the electric field strength is higher than 0.15 V/Å, the tip is flattened and the facet forming process for the cathode can be achieved.

Figure 1:
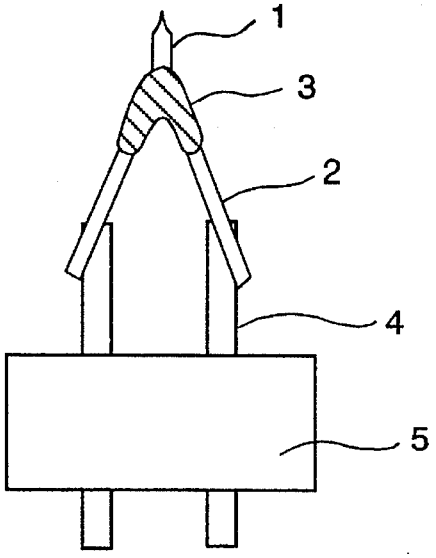
FIG. 1 is a side view of a cathode to which the present invention is applied.
Figure 16:
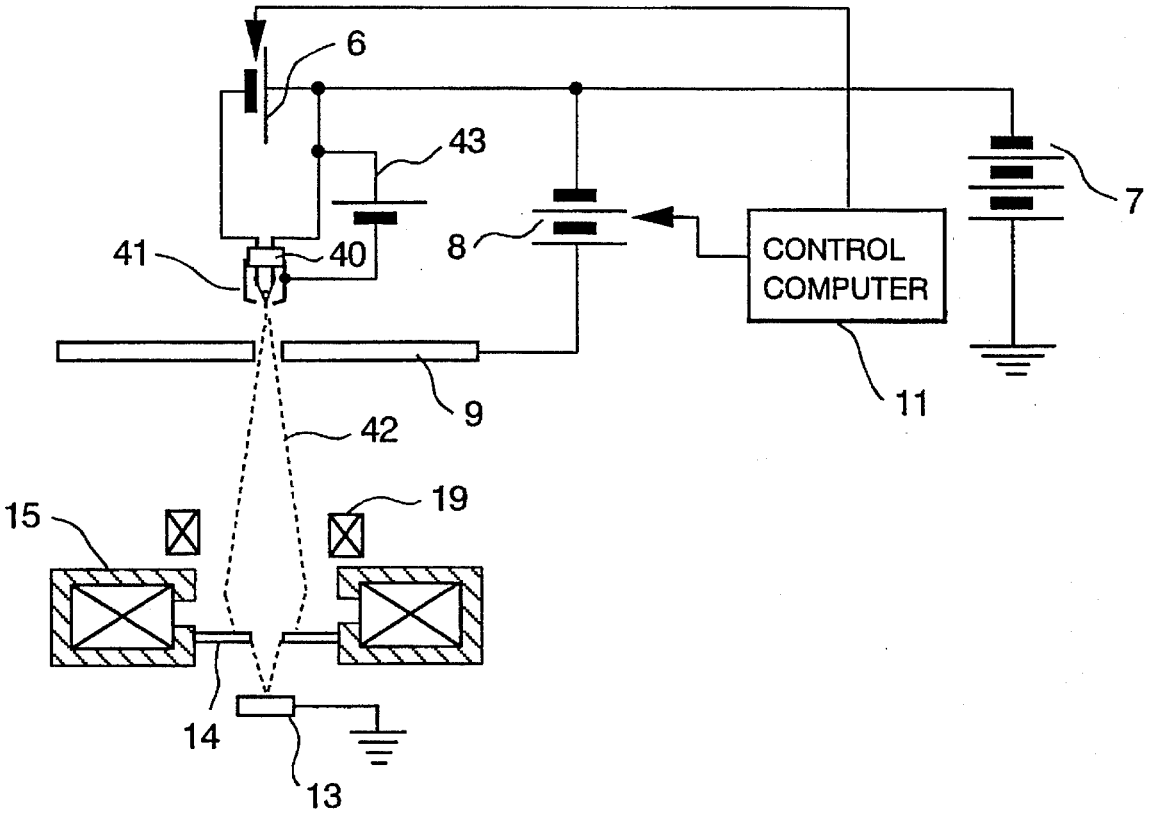
FIG. 16 is a block diagram of an electron beam apparatus with a cathode of an embodiment of the present invention mounted therein.

Next, FIG. 16 shows an example of configuration of the equipment with the aforementioned cathode mounted. Directly under a zirconium Schottky emission cathode 40 with a radius of curvature of 1.2 μm of a longitudinal cross section of a tip and a suppressor electrode 41, an anode 9 is placed and an electric field is formed between the tip of the cathode 40 and the anode 9 by a high-voltage extraction power supply 8. The tip of the cathode 40 is given a high negative potential with respect to the ground potential by an acceleration voltage supply 7. The suppressor electrode 41 is given a negative potential of 300 V to 800 V with respect to the potential of the tip of the cathode 40 by a power supply 43. The tip of the cathode 40 is heated by passing a current through the filament 2 (see FIG. 1) from a heating power supply 6. The extraction power supply 8 is controlled by a control computer 11. Electrons 42 extracted from the cathode 40 pass through the aperture formed at the center of the anode 9, are deflected by a deflection device 19 for scanning of an electron beam, and then focused by an electron lens 15. Electrons having passed through an aperture plate (an object stop) 14 are focused on an sample 13. In this constitution the control computer 11 determines an extraction voltage necessary for application and controls the extraction power supply 8 based upon the relationship shown in FIG. 8 or 9 with the radius of curvature of the longitudinal cross section of the tip of the mounted cathode 40 and a desired energy width ΔE0 among emitted electrons inputted. The desired energy width ΔE0 depends on the accelerating voltage of an electron beam. Its concrete value is determined by aberrations of an electron lens and a deflection device used, a required amount of current of an electron beam, and a required electron beam diameter.

As an example, when an electron beam is emitted at an accelerating voltage higher than 30 kV, the energy width is not set particularly and the extraction voltage is determined only by a desired amount of current. On the other hand, when an electron beam is emitted at an accelerating voltage lower than 5 kV, if the energy width is wide, the beam diameter cannot be focused finely due to chromatic aberrations. Therefore, the desired energy width ΔE0 is set to less than 0.5 eV and an extraction voltage is set to be higher than the equilibrium voltage so as to produce a beam current free from variations. This realizes an electron beam apparatus for providing a stable and a finely-focused electron beam.

When the radius of curvature of a longitudinal cross section of a tip of a cathode is larger than 1.1 μm and a sufficient electric field strength at which no facet collapse occurs is applied, after a facet has been formed once as mentioned above, electrons continue to be emitted stably until the reservoir for diffusion is exhausted and the probe current does not decrease. Actually, however, exactly the same conditions cannot be always kept after maintenance and other checkups of the equipment. In the operation of the restarted equipment, there is a possibility that the shape of the tip of the cathode is different from that in the previous operation. In this case, there is a possibility that a decrease in current occurs after elapse of a long period of time. To prevent it, it is desirable to perform the aforementioned process periodically. As an embodiment thereof, FIG. 17 shows an extract of an operating diary for a critical dimension measurement SEM with the cathode of the present invention mounted. In this case the facet forming process was performed once nearly every two months. The life time of the cathode is nearly one year and the face forming process was performed 6 times during that period of time. As a result, no decrease occurs in the probe current and very stable emission of an electron beam was always obtained.

In the aforementioned embodiment, the period for performing the facet forming process was predetermined. However, due to delicate changes in the tip temperature or changes in the degree of vacuum of the atmosphere around the cathode, a facet collapses abruptly and a decrease in current may occur in a short time. Based upon a fact that the probe current density always decreases gradually starting several hours before an abrupt decrease in current occurs, the facet forming process was performed at the point of time when the probe current decreases by more than 10% from the initial current. Also by doing this, an occurrence of an abrupt decrease in the probe current was suppressed.

Figure 18:
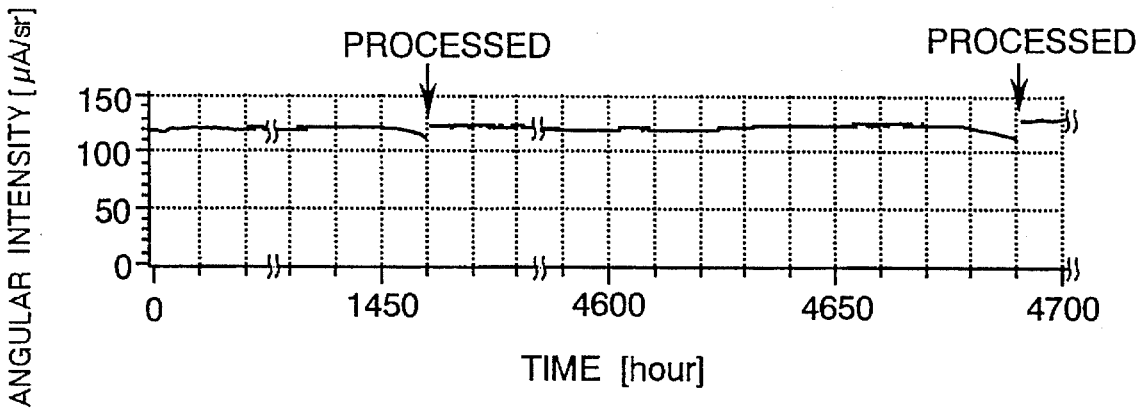
FIG. 18 shows a change of the angular current intensity of a cathode with the passage of time when a method of forming a facet for a cathode of an embodiment of the present invention is applied thereto.

Furthermore, compared with the aforementioned embodiment, there was no need to perform an unnecessary facet forming process and the rate of operation increased. FIG. 18 shows the results the probe currents having been monitored for about one year (for 8500 hours) under such a condition. The period during which the probe current has been stable is omitted and only the portions for some time before and after the facet forming process was performed are shown. The facet forming process was performed two times during 8500 hours. The conditions for the processing are the same as those in the aforementioned embodiment. About two months have elapsed since starting the operation of the equipment, but the current did not decrease at all, and the facet forming process was not performed. Since the probe current decreased by 10% some time after two months (1450 hours) elapsed, the facet forming process was performed at that point of time. Since the probe current decreased by 10% again after 6.5 months (4680 hours) elapsed, the facet forming process was performed at that point of time. The cathode was replaced after one year (8500 hours). By these operations, an abrupt decrease in current could be prevented perfectly. Except a special case in which the amount of probe current is strictly specified, there is no need to perform the facet forming process just after the probe current decreases to less than 10%, and no problem arises generally if the facet forming process is performed before the probe current decreases to 15 to 20%. In short, it is desirable to monitor the probe current and perform the facet forming process when the current decreases below a predetermined value so as to prevent the current from decreasing abruptly.

Figure 19:
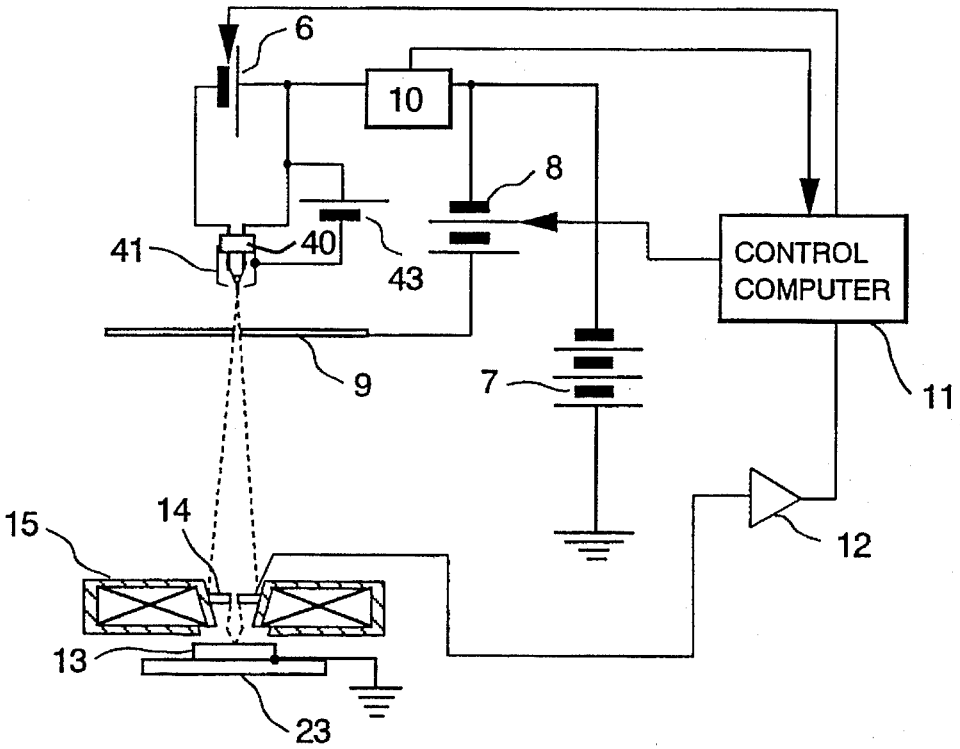
FIG. 19 is a schematic configuration of an equipment for practicing a method of forming a facet for a cathode of an embodiment of the present invention.

Next, an example of the constitution of an electron beam apparatus for realizing the aforementioned embodiment is shown in FIG. 19. The configurations of a power supply for extracting an electron beam and electrodes such as the anode are the same as those shown in FIG. 16. Electrons extracted from a cathode 40 pass through the hole made at the center of an anode 9 and are focused by an electron lens 15. Electrons having passed through an aperture plate (object stop) 14 are focused on a sample 13. The aperture plate 14 is connected to the input of an amplifier 12. Numeral 23 indicates an object stage. Electrons intercepted by the aperture plate 14 are absorbed by it, and a resultant current is amplified and converted into a voltage signal by the amplifier 12, and sent to a control computer 11. This signal corresponds to the probe current described thus far.

When the facet forming process is scheduled to be performed periodically as mentioned above, the period and time for the facet forming process are set in the control computer beforehand. When the facet forming process is scheduled to be performed on the basis of an amount of decrease in the probe current as mentioned above, the control computer 11 is set to control an extraction power supply 8 and a heating power supply 6 using the signal from the amplifier 12 according to the procedure described in the aforementioned embodiment. There are various means available for measuring the probe current other than the object stop 14. For example, in an electron beam application apparatus provided with a beam-blanking device, the extraction power supply 8 and the heating power supply 6 can be controlled by measuring a probe electron current entered into a current measuring device such as a Farady cup during a period of blanking. In short, the probe current is measured periodically and continuously by some method and the cathode is controlled with the measured results.

Figure 20:
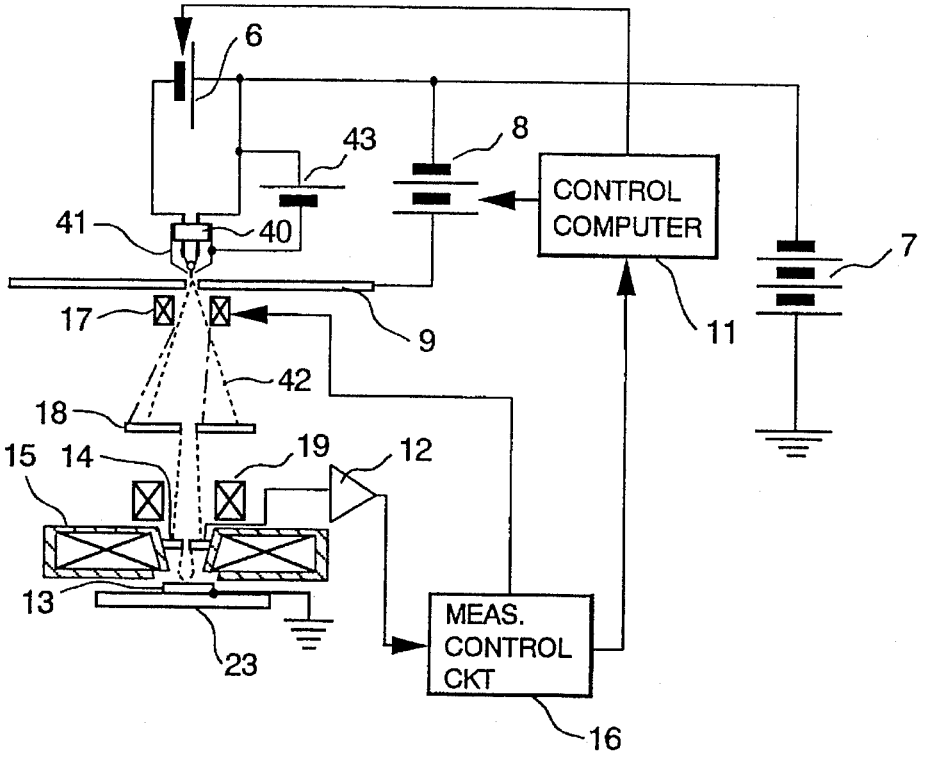
FIG. 20 is a schematic configuration of an equipment for practicing a method of forming a facet for a cathode of another embodiment of the present invention.

In the aforementioned example, whether the facet forming process for the cathode is necessary or not is judged from a change in the probe current with the passage of time. In the following embodiment, a method of judging whether the facet forming process for the cathode is necessary or not from only one measured result will be described. This method predicts a decrease in current density beforehand by measuring an angular distribution of emission current density. The constitution of this electron beam apparatus will be explained with reference to FIG. 20.

The configurations of a power supply for extracting an electron beam from a cathode 40 and electrodes such as the anode are the same as those shown in FIG. 16. Electrons 42 extracted from the cathode 40 pass through the hole made at the center of an anode 9, pass through a deflection device for measuring the angular intensity 17, pass through a stop 18 and a deflection device 19, and are focused by an aperture plate 14 and an object lens 15. Electrons having passed through the object stop 14 are focused on a sample 13. The aperture plate 14 is connected to the input of an amplifier 12. Electrons intercepted by the aperture plate 14 are absorbed by the aperture plate 14, a resultant current is amplified and converted into a voltage signal by the amplifier 12, and sent to a control circuit for measurement of angular intensity 16. The control circuit for measurement of angular intensity 16 generates a deflection signal for the deflection device for measuring the angular intensity 17 and receives a signal from the amplifier 12 in synchronization with the deflection signal. The deflection device for measuring the angular intensity 17 deflects the electron beam 42 unidimensionally centering on 0 m rad which is the center of the axis. The scanning range is ±300 m rad. By doing this, the angular intensity of the electron emission current can be measured.

Figure 21:
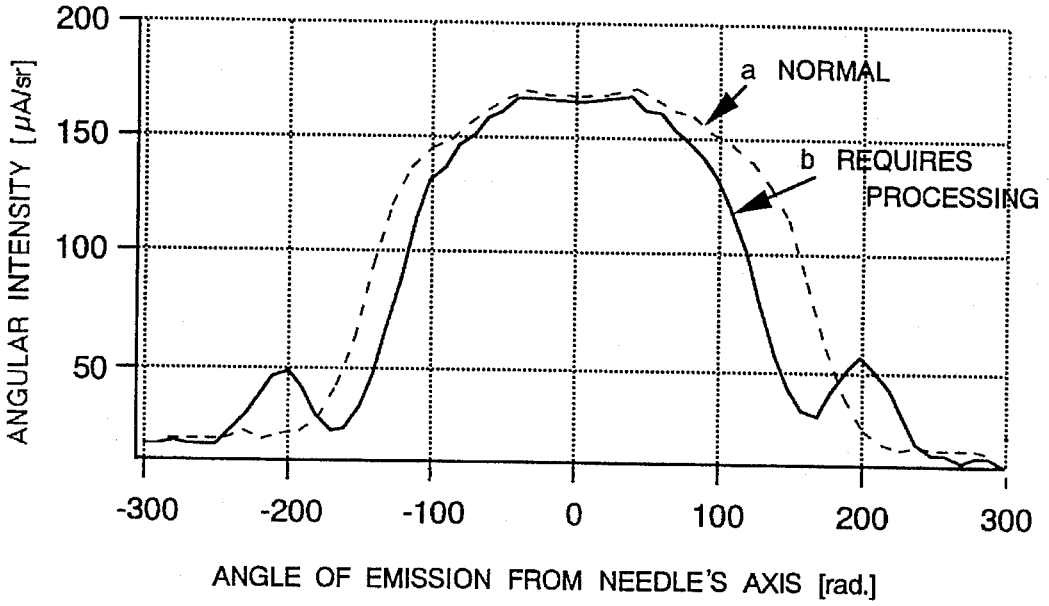
FIG. 21 shows an angular distribution of electron emission current density measured in the embodiment shown in FIG. 20.

In this apparatus, the single crystal tip of the cathode 40 was heated to 1800 K. and electrons were emitted continuously at an extraction voltage of 2 kV. During that period of time, the angular intensity was measured every 24 hours. After a lapse of 2000 hours, the angular intensity, which had been constant, changed. The results are shown in FIG. 21. A broken line "a" indicates an angular intensity before occurrence of changes and the current density was highest at the center and decreased as the peripheral portions are approached. On the other hand, an angular density after changes indicated by a solid line "b" had local minimums of current density in the neighborhood of ±170 m rad. This corresponds to those when dark ring patterns exist as shown in FIGS. 4(*a*) and 4(*b*). The cathode was left operating again, the position of each of the minimums approached the center and after 48 hours an abrupt decrease occurred in a current for illuminating an object.

Figure 13:
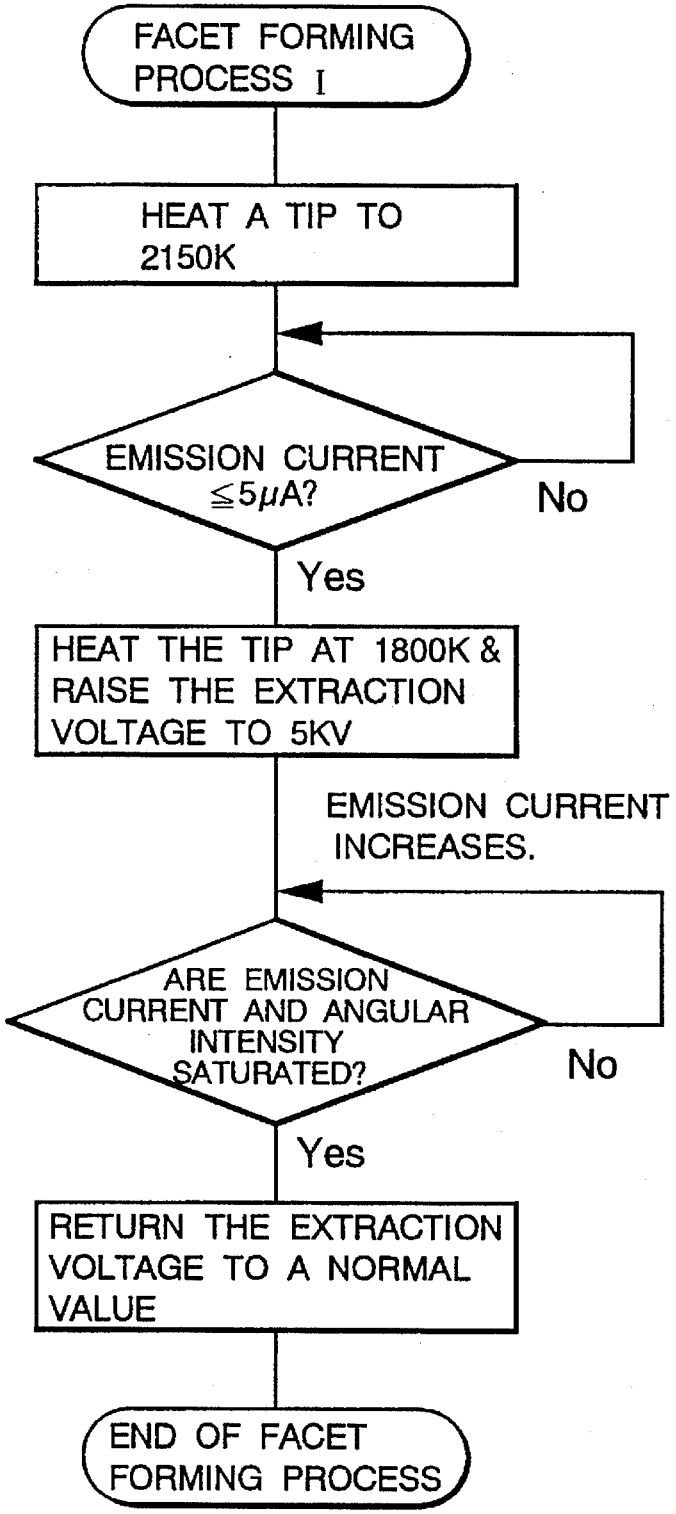
FIG. 13 is a flow chart of the embodiment shown in FIGS. 12(*a*), 12(*b*), 12(*c*), and 12(*d*).
Figure 14A:
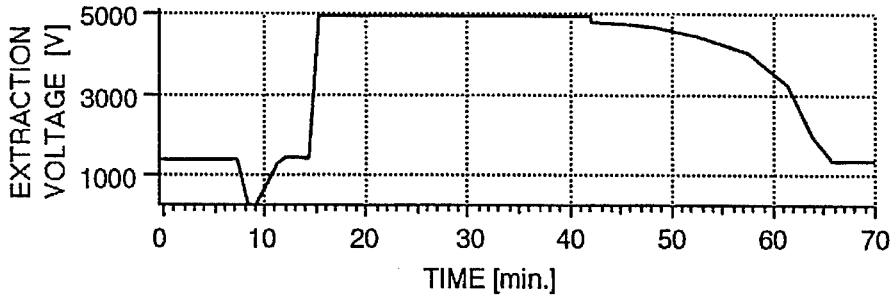
FIGS. 14(*a*), 14(*b*), 14(*c*), and 14(*d*) are figures indicating extraction voltage vs. time, tip temperature of a cathode vs. time, angular current intensity vs. time, and electron emission current vs. time respectively in a method of forming a facet for a cathode of still another embodiment of the present invention.
Figure 14B:
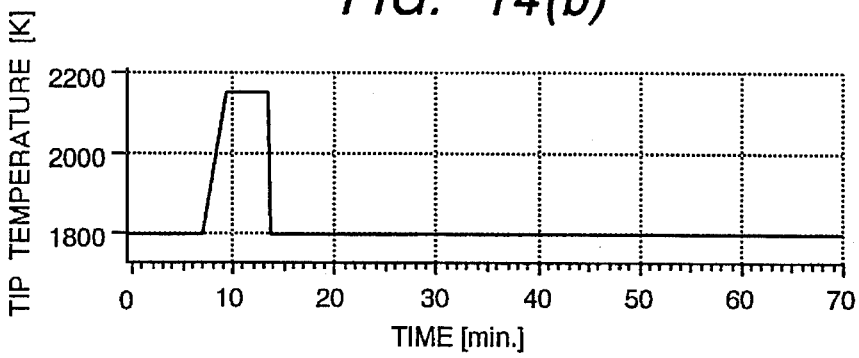
Figure 14C:
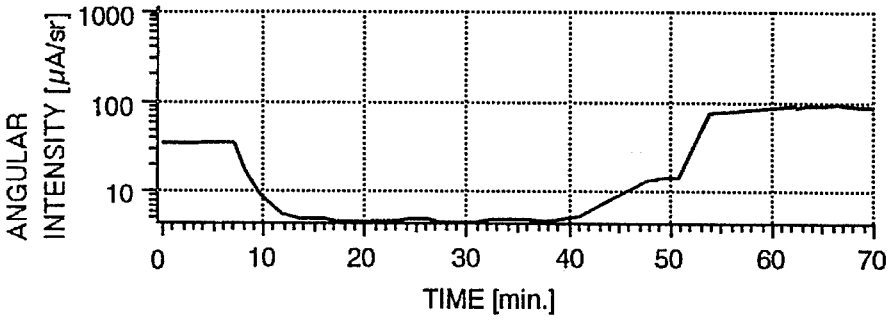
Figure 14D:
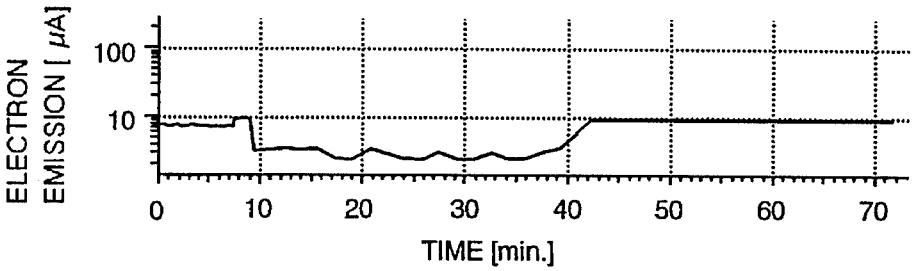
Figure 15:
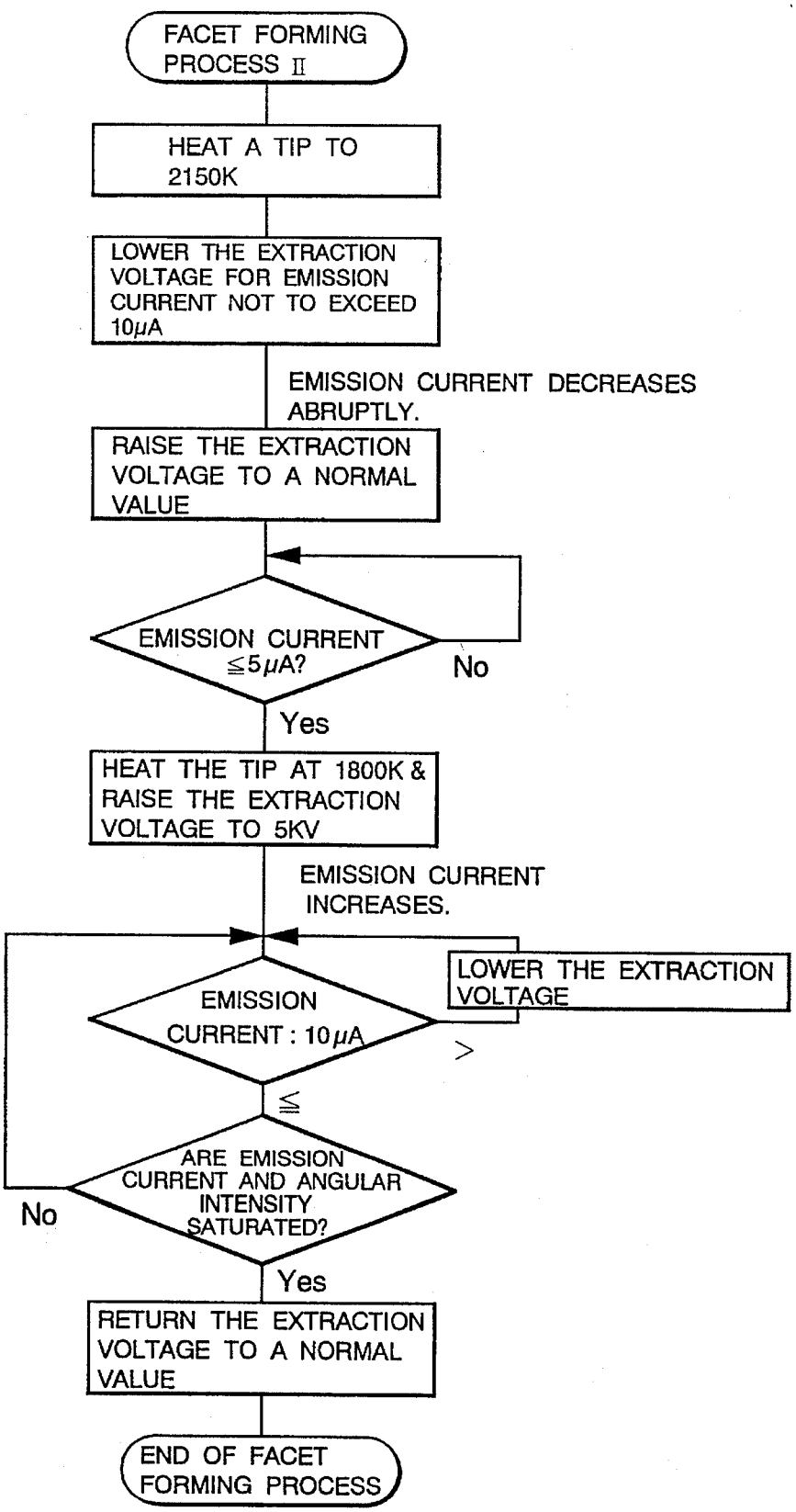
FIG. 15 is a flow chart of the embodiment shown in FIGS. 14(*a*), 14(*b*), 14(*c*), and 14(*d*).

Therefore, at the point of time when an angular intensity such as the curve "b" shown in FIG. 21 was found by measurement, the process described in the embodiment shown in FIG. 13 or 15 was applied. When a flat portion (hereinafter called a facet) of the W(100) surface was reformed by this process, an angular intensity like the curve "a" shown in FIG. 21 was obtained again.

Figure 22:
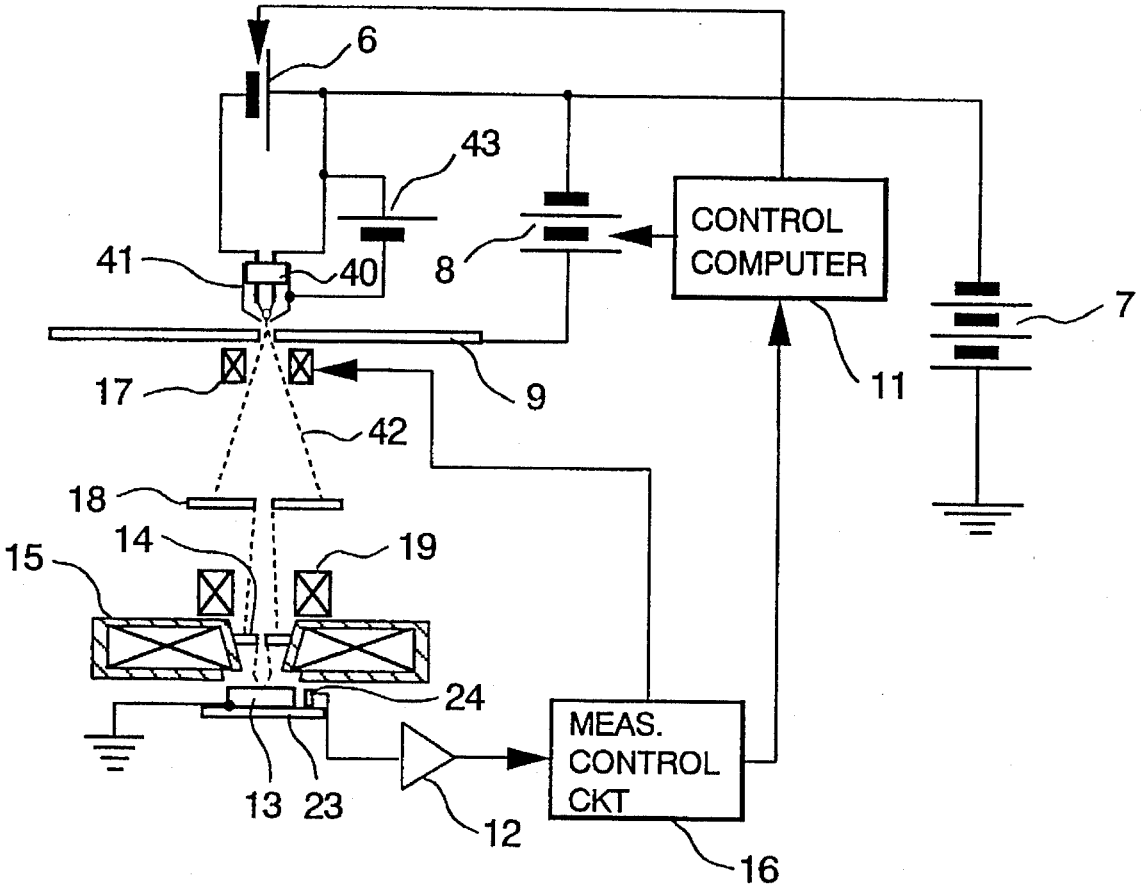
FIG. 22 is a schematic configuration of an equipment for practicing a method of forming a facet for a cathode of still another embodiment of the present invention.

FIG. 22 shows an example of configuration of the equipment in which current for measuring an angular intensity is measured by using a Farady cup fitted at the peripheral portion of the object stage instead of the object stop 14. A Farady cup 24 is fitted at the peripheral portion of an object stage 23. An electron current detected by the Farady cup 24 is sent to the control circuit for measurement of angular intensity 16 via the amplifier 12. When an angular intensity is measured, the object stage 23 moves so that the electron beam 42 enters the Farady cup 24. Other operating conditions are exactly the same as those in the aforementioned embodiments. To measure an angular distribution of current density, the deflection device for measuring the angular intensity 17 is operated so as to deflect the electron beam 42, and the electron beam 42 intended to enter the Farady cup 24 also deviates with deflection. The size of the opening of the Farady cup 24 is made so large that even if the electron beam 42 is deflected by ±300 m rad by the deflection device 19, the electron beam 42 will not miss the opening. This embodiment in which the Farady cup 24 is used for measurement has an advantage that its resolution of angular intensity is higher compared with the embodiment in which the object stop 14 is used for measurement.

Some concrete embodiments have been described above. However, many other concrete configurations for measuring an angular intensity can be used. In short, it is necessary to provide a deflection device for deflecting an electron beam emitted from a Schottky emission cathode and an electron detecting means for detecting only an electron beam deflected at a specific angle at a specific time.

The embodiments of a cathode which can obtain stable electron emission with a narrow energy width by optimizing the radius of curvature of a longitudinal cross section of a tip of the cathode and applying an electric field strength within a specific range, a manufacturing method thereof, a facet forming method for the cathode, and a configuration of the equipment using this cathode are explained above using an example of a cathode having Zr and O adsorbed on its W(100) surface. However, the invention is not limited to the above embodiments. To a cathode having a piece of a single crystal refractory metal and an adsorbed layer of a metal whose work function or electron affinity is lower than that of the single crystal formed at the tip of single crystal piece wherein the tip of the single crystal is heated and given an electric field to emit electrons, similar methods can be applied. For example, the tungsten orientation <100>, <110>, or <111> may be used as a single crystal refractory metal and Ti, Hf, Y, and Sc and O, N, and C may be used as elements to be adsorbed as mentioned above.

According to the present invention, by increasing a radius of curvature of a longitudinal cross section of a tip of a cathode, even if an electric field sufficient for maintaining a facet is applied, electron emission having a narrow energy width can be obtained. By doing this, stable emission of electrons of good quality can obtained for many hours.

What is claimed is:

1. A Schottky emission cathode comprising:

a filament, a needle-shaped piece of single crystal refractory metal having a flat crystal surface at a tip thereof and attached to said filament, said needle-shaped piece of single crystal refractory metal being adapted to be heated by passing a current through said filament and to have an electric field applied on said tip so that electrons are extracted from said tip, and an adsorbed layer including at least one kind of metal other than said single crystal refractory metal on said flat crystal surface;

a radius of curvature of a longitudinal cross section of said tip being of a value larger than a radius of curvature at an intersection of a curve of an equilibrium field strength for exerting an electrostatic force balancing with a surface diffusion at said tip vs. a radius of curvature of a longitudinal cross section of said tip and a curve of an electric field strength for extracting electrons of an energy width of a predetermined value among said extracted electrons from said tip vs. a radius of curvature of a longitudinal cross section of said tip, and smaller than 2.5 μm.

2. A Schottky emission cathode according to claim 1, wherein said predetermined value is about 0.5 eV.

3. A Schottky emission cathode according to claim 1, wherein said radius of curvature is within a range from 1.1 μm to 2.5 μm.

4. A Schottky emission cathode according to claim 1, wherein said needle-shaped piece of single crystal refractory metal has one of the tungsten crystal orientations <100>, <110>, and >111> and said adsorbed layer comprises one or more elements of a group consisting of Zr, Ti, Hf, Y, Sc, V and Nb and one element from a group consisting of O, N and C.

5. A Schottky emission cathode according to claim 1, wherein said needle-shaped piece of single crystal refractory metal has a tungsten crystal orientation <100>, said adsorbed layer comprises Zr and O, and radius of curvature of said tip of said needle-shaped piece of single crystal refractory metal is between 1.1 μm and 2.5 μm.

6. A Schottky emission cathode according to claim 2, wherein said radius of curvature of said needle-shaped piece of single crystal refractory metal is formed by etching a piece of said single crystal refractory metal into a needle shape in an etching solution and then heating said piece to a temperature higher than 2000 K. in a vacuum to obtain a desired radius of curvature.

7. A Schottky emission cathode according to claim 3, wherein said radius of curvature of said needle-shaped piece of single crystal refractory metal is formed by etching a piece of said single crystal refractory metal into a needle shape in an etching solution and then heating said piece to a temperature higher than 2000 K. in a vacuum to obtain a desired radius of curvature.

8. A Schottky emission cathode comprising:

a filament, a needle-shaped piece of single crystal refractory metal having a flat crystal surface at a tip thereof and attached to said filament, said needle-shaped piece of single crystal refractory metal being adapted to be heated by passing a current through said filament and to have an electric field applied on said tip so that electrons are extracted from said tip, and an adsorbed layer including at least one kind of metal other than said single crystal refractory metal on said flat crystal surface;

a radius of curvature of a longitudinal cross section of said tip being of a value to produce an energy width among electrons extracted from said tip not exceeding a predetermined value with said electric field being sufficient to prevent said flat crystal surface from collapsing during operation of said cathode, wherein said radius of curvature of said needle-shaped piece of single crystal refractory metal is formed by etching a piece of said single crystal refractory metal into a needle shape in an etching solution and then heating said piece to a temperature higher than 2000 K. in a vacuum to obtain a desired radius of curvature.

9. A Schottky emission cathode element comprising:

a filament, a needle-shaped piece of single crystal refractory metal having a flat crystal surface at a tip thereof and attached to said filament, said needle-shaped piece of single crystal refractory metal being adapted to be heated by passing a current through said filament and to have an electric field applied on said tip so that electrons are extracted from said tip, an adsorbed layer including at least one kind of metal other than said single crystal refractory metal on said flat crystal surface, leads for supporting said filament and passing said current through said filament, and an insulator for embedding and fixing said leads;

a radius of curvature of a longitudinal cross section of said tip being of a value larger than a radius of curvature at an intersection of a curve of an equilibrium field strength for exerting an electrostatic force balancing with a surface diffusion at said tip vs. a radius of curvature of a longitudinal cross section of said tip and a curve of an electric field strength for extracting electrons of an energy width of a predetermined value among said extracted electrons from said tip vs. a radius of curvature of a longitudinal cross section of said tip, and smaller than 2.5 μm.

10. A Schottky emission cathode element according to claim 9, wherein said predetermined value is about 0.5 eV.

11. A Schottky emission cathode element according to claim 9, wherein said radius of curvature is within a range from 1.1 μm to 2.5 μm.

12. A Schottky emission cathode element according to claim 9, wherein said needle-shaped piece of single crystal refractory metal has one of the tungsten crystal orientations <100>, <110>, and <111> and said adsorbed layer comprises one or more elements from a group consisting of Ti, Hf, Y, Sc, V, and Nb and one element from a group consisting of O, N, and C.

13. A Schottky emission cathode element according to claim 9, wherein said needle-shaped piece of single crystal refractory metal has a tungsten crystal orientation <100>, said adsorbed layer comprises Zr and O, and said tip of said needle-shaped piece of single crystal refractory metal has a radius of curvature between 1.1 μm and 2.5 μm.

14. A Schottky emission cathode element according to claim 10, wherein said radius of curvature of said needle-shaped piece of single crystal refractory metal is formed by etching a piece of said single crystal refractory metal into a needle shape in an etching solution and then heating said piece to a temperature higher than 2000 K. in a vacuum to obtain a desired radius of curvature.

15. A Schottky emission cathode element according to claim 11, wherein said radius of curvature of said needle-shaped piece of single crystal refractory metal is formed by etching a piece of said single crystal refractory metal into a needle shape in an etching solution and then heating said piece to a temperature higher than 2000 K. in a vacuum to obtain a desired radius of curvature.

16. A Schottky emission cathode element comprising:

a filament, a needle-shaped piece of single crystal refractory metal having a flat crystal surface at a tip thereof and attached to said filament, said needle-shaped piece of single crystal refractory metal being adapted to be heated by passing a current through said filament and to have an electric field applied on said tip so that electrons are extracted from said tip, an adsorbed layer including at least one kind of metal other than said single crystal refractory metal on said flat crystal surface, leads for supporting said filament and passing said current through said filament, and an insulator for embedding and fixing said leads;

a radius of curvature of a longitudinal cross section of said tip being of a value to produce an energy width among electrons extracted from said tip not exceeding a predetermined value with said electric field being sufficient to prevent said flat crystal surface from collapsing during operation of said cathode, wherein said radius of curvature of said needle-shaped piece of single crystal refractory metal is formed by etching a piece of said single crystal refractory metal into a needle shape in an etching solution and then heating said piece to a temperature higher than 2000 K. in a vacuum to obtain a desired radius of curvature.

17. An electron beam apparatus comprising:

a Schottky emission cathode comprising a filament, a needle-shaped piece of single crystal refractory metal having a flat crystal surface at a tip thereof and attached to said filament, said needle-shaped piece of single crystal refractory metal being adapted to be heated by passing a current through said filament and to have an electric field applied on said tip so that electrons are extracted from said tip, and an adsorbed layer including at least one kind of metal other than said single crystal refractory metal on said flat crystal surface, a radius of curvature of a longitudinal cross section of said tip being of a value larger than a radius of curvature at an intersection of a curve of an equilibrium field strength for exerting an electrostatic force balancing with a surface diffusion at said tip vs. a radius of curvature of a longitudinal cross section of said tip and a curve of an electric field strength for extracting electrons of an energy width of a predetermined value among said extracted electrons from said tip vs. a radius of curvature of a longitudinal cross section of said tip, and smaller than 2.5 μm, a heating power supply for supplying said current through said filament, an extraction power supply for supplying said electric field, an accelerating power supply for accelerating said extracted electrons, a control computer for controlling said extraction power supply for said electric field to maintain a stable electron emission with an energy width not exceeding said predetermined value, and an electron lens provided with an aperture plate for focusing a beam of said extracted electrons and illuminating an object with said beam.

18. An electron beam apparatus for use with a cathode comprising a filament formed of a hairpin-shaped piece of refractory metal, a piece of single crystal refractory metal attached to said filament, and an adsorbed layer including a metal whose work function or electron affinity is lower than that of said single crystal refractory metal and attached to a tip of said piece of single crystal refractory metal comprising:

a heating power supply for heating said piece of single crystal refractory metal by a current through said filament to a temperature sufficient to maintain said adsorbed layer stably, a voltage supply for supplying an electric field to said tip of said piece of single crystal refractory metal to extract electrons therefrom, an accelerating power supply for accelerating said electrons extracted from said cathode, a lens provided with an aperture plate for focusing said extracted electrons and illuminating an object with said electrons, and means for measuring an angular current density distribution of said extracted electrons from said cathode, wherein, when two or more local minimums are detected in said angular current density distribution, said electron beam apparatus extracts electrons from said tip of said piece of single crystal refractory metal by heating by passing a current through said filament to a temperature sufficient to maintain said adsorbed layer stably and applying an electric field on said tip, removes said adsorbed layer first, and then applies an electric field appropriate for preventing said tip from blunting due to migration of atoms from said tip until an electron emission current from said cathode saturates.

19. An electron beam apparatus according to claim 18, wherein said means for measuring an angular current density distribution of said extracted electrons comprises:

an anode electrode disposed directly under said cathode, a deflection device for scanning of an electron beam downstream of said anode electrode, a stop for measuring angular intensity distribution downstream of said deflection device for scanning of an electron beam, and means for detecting a current downstream of said stop, and wherein a current by said electron beam is measured by said current detecting means in synchronization with scanning of said electron beam by said deflection device.

20. An electron beam apparatus according to claim 19, wherein said means for detecting a current detects a current illuminating an aperture plate downstream of said aperture plate for measuring angular intensity distribution via an amplifier.

21. An electron beam apparatus according to claim 19, wherein said means for detecting a current comprises an electrode for detecting a current mounted on an object stage downstream of said lens and said object stage is movable so that said electrons illuminate said electrode for detecting a current at a time of measuring an angular intensity distribution.

22. An electron beam apparatus comprising:

a Schottky emission cathode comprising a filament, a needle-shaped piece of single crystal refractory metal having a flat crystal surface at a tip thereof and attached to said filament, and an adsorbed layer including at least one kind of metal other than said single crystal refractory metal on said flat crystal surface, a radius of curvature of a longitudinal cross section of said tip being of a value larger than a radius of curvature at an intersection of a curve of an equilibrium field strength for exerting an electrostatic force balancing with a surface diffusion at said tip vs. a radius of curvature of a longitudinal cross section of said tip and a curve of an electric field strength for extracting electrons of an energy width of a predetermined value among said extracted electrons from said tip vs. a radius of curvature of a longitudinal cross section of said tip, and smaller than 2.5 μm, said needle-shaped piece of single crystal refractory metal being adapted to be heated by passing a current through said filament and to have an electric field applied on said tip so that electrons are extracted from said tip, a heating power supply for supplying said current through said filament, an extraction power supply for supplying an electric field to extract electrons from said Schottky emission cathode, an accelerating power supply for accelerating said extracted electrons from said Schottky emission cathode, a control computer for controlling said extraction power supply for said electric field to maintain a stable electron emission having an energy width narrower than said predetermined value, and an electron lens provided with an aperture plate for focusing said extracted electrons and illuminating an object with said extracted electrons.

23. A method of forming a cathode facet comprising the steps of:

providing a cathode comprising a filament formed of a hairpin-shaped piece of refractory metal, a piece of single crystal refractory metal attached to said filament, and an adsorbed layer including a metal whose work function or electron affinity is lower than that of said single crystal refractory metal and attached to a tip of said piece of single crystal refractory metal;

extracting electrons from said tip of said piece of single crystal refractory metal by heating by passing a current through said filament to a temperature sufficient to maintain said adsorbed layer stably and applying an electric field on said tip;

removing said adsorbed layer first, and then applying an electric field appropriate for preventing said tip from blunting due to migration of atoms from said tip until an electron emission current from said cathode saturates.

24. A method of forming a cathode facet according to claim 23, wherein said method is carried out periodically.

25. A method of forming a cathode facet according to claim 23, wherein said method is carried out when an angular intensity at a center portion of said tip decreases from an initially predetermined value by a predetermined percent.

26. A method of forming a cathode facet comprising the steps of:

providing a cathode comprising a filament formed of a hairpin-shaped piece of refractory metal, a piece of single crystal refractory metal attached to said filament, and an adsorbed layer including a metal whose work function or electron affinity is lower than that of said single crystal refractory metal and attached to a tip of said piece of single crystal refractory metal;

extracting electrons from said tip of said piece of single crystal refractory metal by heating said tip by passing a current through said filament to a temperature at which said adsorbed layer evaporates and by applying an electric field on said tip;

returning said tip to a temperature at which said adsorbed layer is maintained stably after an electron emission pattern observable by bombarding an electroluminescent target with said electrons extracted from said tip disappears; and applying an electric field necessary for preventing said tip from blunting due to migration of atoms from said tip on said tip until said electron emission pattern appears as a nearly uniform circle.

27. A method of forming a cathode facet according to claim 26, wherein said method is carried out periodically.

28. A method of forming a cathode facet according to claim 26, wherein said method is carried out when an angular intensity at a center portion of said tip decreases from an initially predetermined value by a predetermined percent.

29. A method of forming a cathode facet comprising the steps of:

providing a cathode comprising a filament formed of a hairpin-shaped piece of refractory metal, a piece of single crystal refractory metal attached to said filament, and an adsorbed layer including a metal whose work function or electron affinity is lower than that of said piece of single crystal refractory metal and attached to a tip of said piece of single crystal refractory metal;

continuing to extract electrons from said tip by applying an electric field on said tip and heating said tip by passing a current through said filament to a temperature at which said adsorbed layer evaporates until an emission current decreases to less than 5 μA;

returning said tip to a temperature at which said adsorbed layer is maintained stably; and applying an electric field necessary for preventing said tip from blunting due to migration of atoms from said tip on said tip until the electron emission current saturates.

30. A method of forming a cathode facet according to claim 29, wherein said method is carried out periodically.

31. A method of forming a cathode facet according to claim 29, wherein said method is carried out when an angular intensity at a center portion of said tip decreases from an initially predetermined value by a predetermined percent.

32. A method of forming a cathode facet comprising the steps of:

providing a cathode comprising a filament formed of a hairpin-shaped piece of refractory metal, a piece of single crystal refractory metal attached to said filament, and an adsorbed layer including a metal whose work function or electron affinity is lower than that of said single crystal refractory metal and attached to a tip of said piece of single crystal refractory metal;

extracting electrons from said tip of said piece of single crystal refractory metal by heating said piece of single crystal refractory metal by passing a current through said filament to a temperature at which said adsorbed layer evaporates and applying an electric field on said tip; and then applying an electric field necessary for preventing said tip from blunting due to migration of atoms from said tip on said tip and controlling the electric field at said tip so that an electron emission current does not exceed a predetermined value at the same time.

33. A method of forming a cathode facet according to claim 32, wherein said method is carried out periodically.

34. A method of forming a cathode facet according to claim 32, wherein said method is carried out when an angular intensity at a center portion of said tip decreases from an initially predetermined value by a predetermined percent.

35. A method of forming a cathode facet comprising the steps of:

providing a cathode comprising a filament formed of a hairpin-shaped piece of tungsten, a piece of single crystal refractory metal of tungsten of crystal orientation <100> attached to said filament, and an adsorbed layer of zirconium and oxygen attached to a tip of said piece of single crystal refractory metal;

extracting electrons from said tip by applying an electric field on said tip;

raising a temperature of said adsorbed layer to more than 1900 K. until an electron emission current reaches an equilibrium state of one of less than 5 μA and an angular intensity of less than 5 μA/sr over a whole useful electron-emissive region of said tip; and then lowering the temperature of said adsorbed layer to less than 1900 K. next and to apply an electric field of more than 0.15 V/Å on said tip until the electron emission current saturates.

36. A method of forming a cathode facet according to claim 35, wherein said method is carried out periodically.

37. A method of forming a cathode facet according to claim 35, wherein said method is carried out when an angular intensity at a center portion of said tip decreases from an initially predetermined value by a predetermined percent.

38. A method of forming a cathode facet comprising the steps of:

providing a cathode comprising a filament formed of a hairpin-shaped piece of tungsten, a piece of single crystal refractory metal of tungsten of crystal orientation <100> attached to said filament, and an adsorbed layer of zirconium and oxygen attached to a tip of said piece of single crystal refractory metal;

heating said tip of said piece of single crystal refractory metal to more than 1900 K. without applying an electric field on said tip;

applying and controlling an electric field on said tip so that an emission current does not exceed a predetermined value until the electron emission current reaches a state of one of less than 5 μA and an angular current intensity of less than 5 μA/sr over a whole useful electron-emissive region of said tip; and then lowering a temperature of said adsorbed layer to less than 1900 K. and controlling the electric field at said tip by applying an electric field of more than 0.15 V/Å at the same time so that the electron emission current does not exceed a predetermined value.

39. A method of forming a cathode facet according to claim 38, wherein said method is carried out periodically.

40. A method of forming a cathode facet according to claim 38, wherein said method is carried out when an angular intensity at a center portion of said tip decreases from an initially predetermined value by a predetermined percent.

41. An electron beam apparatus for use with a cathode comprising a filament formed of a hairpin-shaped piece of refractory metal, a piece of single crystal refractory metal attached to said filament, and an adsorbed layer including a metal whose work function or electron affinity is lower than that of said single crystal refractory metal and attached to a tip of said piece of single crystal refractory metal comprising:

a heating power supply for heating said piece of single crystal refractory metal by a current through said filament to a temperature sufficient to maintain said adsorbed layer stably, a voltage supply for supplying an electric field to said tip of said piece of single crystal refractory metal to extract electrons therefrom, an accelerating power supply for accelerating said electrons extracted from said cathode, a lens provided with an aperture plate for focusing said extracted electrons and illuminating an object with said electrons, and means for measuring an angular current density distribution of said extracted electrons from said cathode, wherein, when two or more local minimums are detected in said angular current density distribution, said electron beam apparatus continues to extract electrons from said tip by applying an electric field on said tip and heating said tip by passing a current through said filament to a temperature at which said adsorbed layer evaporates until an emission current decreases to less than 5 μA, returns said tip to a temperature at which said adsorbed layer is maintained stably, and applies an electric field necessary for preventing said tip from blunting due to migration of atoms from said tip on said tip until the electron emission current saturates.

42. An electron beam apparatus according to claim 41, wherein said means for measuring an angular current density distribution of said extracted electrons comprises:

an anode electrode disposed directly under said cathode, a deflection device for scanning of an electron beam downstream of said anode electrode, a stop for measuring angular intensity distribution downstream of said deflection device for scanning of an electron beam, and means for detecting a current downstream of said stop, and wherein a current by said electron beam is measured by said current detecting means in synchronization with scanning of said electron beam by said deflection device.

43. An electron beam apparatus for use with a cathode comprising a filament formed of a hairpin-shaped piece of refractory metal, a piece of single crystal refractory metal attached to said filament, and an adsorbed layer including a metal whose work function or electron affinity is lower than that of said single crystal refractory metal and attached to a tip of said piece of single crystal refractory metal comprising:

a heating power supply for heating said piece of single crystal refractory metal by a current through said filament to a temperature sufficient to maintain said adsorbed layer stably, a voltage supply for supplying an electric field to said tip of said piece of single crystal refractory metal to extract electrons therefrom, an accelerating power supply for accelerating said electrons extracted from said cathode, a lens provided with an aperture plate for focusing said extracted electrons and illuminating an object with said electrons, and means for measuring an angular current density distribution of said extracted electrons from said cathode, wherein, when two or more local minimums are detected in said angular current density distribution, said electron beam apparatus extracts electrons from said tip of said piece of single crystal refractory metal by heating said piece of single crystal refractory metal by passing a current through said filament to a temperature at which said adsorbed layer evaporates and applying an electric field on said tip, and then applies an electric field necessary for preventing said tip from blunting due to migration of atoms from said tip on said tip and controls the electric field at said tip so that an electron emission current does not exceed a predetermined value at the same time.

44. An electron beam apparatus according to claim 43, wherein said means for measuring an angular current density distribution of said extracted electrons comprises:

an anode electrode disposed directly under said cathode, a deflection device for scanning of an electron beam downstream of said anode electrode, a stop for measuring angular intensity distribution downstream of said deflection device for scanning of an electron beam, and means for detecting a current downstream of said stop, and wherein a current by said electron beam is measured by said current detecting means in synchronization with scanning of said electron beam by said deflection device.

45. An electron beam apparatus for use with a cathode comprising a filament formed of a hairpin-shaped piece of refractory metal, a piece of single crystal refractory metal attached to said filament, and an adsorbed layer including a metal whose work function or electron affinity is lower than that of said single crystal refractory metal and attached to a tip of said piece of single crystal refractory metal comprising:

a heating power supply for heating said piece of single crystal refractory metal by a current through said filament to a temperature sufficient to maintain said adsorbed layer stably, a voltage supply for supplying an electric field to said tip of said piece of single crystal refractory metal to extract electrons therefrom, an accelerating power supply for accelerating said electrons extracted from said cathode, a lens provided with an aperture plate for focusing said extracted electrons and illuminating on object with said electrons, and means for measuring an angular current density distribution of said extracted electrons from said cathode, wherein, when two or more local minimums are detected in said angular current density distribution, said electron beam apparatus heats said tip of said piece of single crystal refractory metal to more than 1900 K. without applying an electric field on said tip, applies and controls an electric field on said tip so that an emission current does not exceed a predetermined value until the electron emission current reaches a state of one of less than 5 μA and an angular current intensity of less than 5 μA/sr over a whole useful electron-emissive region of said tip, and then lowers a temperature of said adsorbed layer to less than 1900 K. and controls the electric field at said tip by applying an electric field of more than 0.15 V/Å at the same time so that the electron emission current does not exceed a predetermined value.

46. An electron beam apparatus according to claim 45, wherein said means for measuring an angular current density distribution of said extracted electrons comprises:

an anode electrode disposed directly under said cathode, a deflection device for scanning of an electron beam downstream of said anode electrode, a stop for measuring angular intensity distribution downstream of said deflection device for scanning of an electron beam, and means for detecting a current downstream of said stop, and wherein a current by said electron beam is measured by said current detecting means in synchronization with scanning of said electron beam by said deflection device.

47. A cathode-stabilizing apparatus for use with a cathode comprising a filament formed of a hairpin-shaped piece of refractory metal, a piece of single crystal refractory metal attached to said filament, and an adsorbed layer including a metal whose work function or electron affinity is lower than that of said single crystal refractory metal and attached to a tip of said piece of single crystal refractory metal, said piece of single crystal refractory metal being adapted to be heated by passing a current through said filament and to have an electric field applied on said tip so that electrons are extracted from said tip comprising:

a heating power supply for supplying said current through said filament, an extraction power supply for supplying said electric field, an accelerating power source for accelerating said extracted electrons, an electron lens provided with an aperture plate for focusing said extracted electrons and illuminating an object with said extracted electrons, and a control computer for controlling said three power supplies, wherein, when an electron current adsorbed in said aperture plate decreases by a predetermined value, said control computer controls said heating power supply and said extraction power supply such that said cathode-stabilizing apparatus extracts electrons from said tip of said piece of single crystal refractory metal by heating by passing a current through said filament to a temperature sufficient to maintain said adsorbed layer stably and applying an electric field on said tip, removes said adsorbed layer first, and then applies an electric field appropriate for preventing said tip from blunting due to migration of atoms from said tip until an electron emission current from said cathode saturates.

48. A cathode-stabilizing apparatus for use with a cathode comprising a filament formed of a hairpin-shaped piece of refractory metal, a piece of single crystal refractory metal attached to said filament, and an adsorbed layer including a metal whose work function or electron affinity is lower than that of said single crystal refractory metal and attached to a tip of said piece of single crystal refractory metal, said piece of single crystal refractory metal being adapted to be heated by passing a current through said filament and to have an electric field applied on said tip so that electrons are extracted from said tip comprising:

a heating power supply for supplying said current through said filament, an extraction power supply for supplying said electric field, an accelerating power source for accelerating said extracted electrons, an electron lens provided with an aperture plate for focusing said extracted electrons and illuminating an object with said extracted electrons, and a control computer for controlling said three power supplies, wherein, when an electron current adsorbed in said aperture plate decreases by a predetermined value, said control computer controls said heating power supply and said extraction power supply such that said cathode-stabilizing apparatus continues to extract electrons from said tip by applying an electric field on said tip and heating said tip by passing a current through said filament to a temperature at which said adsorbed layer evaporates until an emission current decreases to less than 5 μA, returns said tip to a temperature at which said adsorbed layer is maintained stably, and applies an electric field necessary for preventing said tip from blunting due to migration of atoms from said tip on said tip until the electron emission current saturates.

49. A cathode-stabilizing apparatus for use with a cathode comprising a filament formed of a hairpin-shaped piece of refractory metal, a piece of single crystal refractory metal attached to said filament, and an adsorbed layer including a metal whose work function or electron affinity is lower than that of said single crystal refractory metal and attached to a tip of said piece of single crystal refractory metal, said piece of single crystal refractory metal being adapted to be heated by passing a current through said filament and to have an electric field applied on said tip so that electrons are extracted from said tip comprising:

a heating power supply for supplying said current through said filament, an extraction power supply for supplying said electric field, an accelerating power source for accelerating said extracted electrons, an electron lens provided with an aperture plate for focusing said extracted electrons and illuminating an object with said extracted electrons, and a control computer for controlling said three power supplies, wherein, when an electron current adsorbed in said aperture plate decreases by a predetermined value, said control computer controls said heating power supply and said extraction power supply such that said cathode-stabilizing apparatus extracts electrons from said tip of said piece of single crystal refractory metal by heating said piece of single crystal refractory metal by passing a current through said filament to a temperature at which said adsorbed layer evaporates and applying an electric field on said tip, and then applies an electric field necessary for preventing said tip from blunting due to migration of atoms from said tip on said tip and controls the electric field at said tip so that an electron emission current does not exceed a predetermined value at the same time.

50. A cathode-stabilizing apparatus for use with a cathode comprising a filament formed of a hairpin-shaped piece of refractory metal, a piece of single crystal refractory metal attached to said filament, and an adsorbed layer including a metal whose work function or electron affinity is lower than that of said single crystal refractory metal and attached to a tip of said piece of single crystal refractory metal, said piece of single crystal refractory metal being adapted to be heated by passing a current through said filament and to have an electric field applied on said tip so that electrons are extracted from said tip comprising:

a heating power supply for supplying said current through said filament, an extraction power supply for supplying said electric field, an accelerating power source for accelerating said extracted electrons, an electron lens provided with an aperture plate for focusing said extracted electrons and illuminating an object with said extracted electrons, and a control computer for controlling said three power supplies, wherein, when an electron current adsorbed in said aperture plate decreases by a predetermined value, said control computer controls said heating power supply and said extraction power supply such that said cathode-stabilizing apparatus heats said tip of said piece of single crystal refractory metal to more than 1900 K. without applying an electric field on said tip, applies and controls an electric field on said tip so that an emission current does not exceed a predetermined value until the electron emission current reaches a state of one of less than 5 μA and an angular current intensity of less than 5 μA/sr over a whole useful electron-emissive region of said tip, and then lowers a temperature of said adsorbed layer to less than 1900 K. and controls the electric field at said tip by applying an electric field of more than 0.15 V/Å at the same time so that the electron emission current does not exceed a predetermined value.

* * * * *